US011135463B2

(12) United States Patent
Rindfleisch

(10) Patent No.: US 11,135,463 B2
(45) Date of Patent: Oct. 5, 2021

(54) MOTOR-DRIVEN VARIABLE WEIGHT EXERCISE DEVICE WITH MODULAR CHASSIS BODY

(71) Applicant: Maureen Rose Lex, Sheboygan, WI (US)

(72) Inventor: Randy Royce Rindfleisch, Sheboygan, WI (US)

( * ) Notice: Subject to any disclaimer, the term of this patent is extended or adjusted under 35 U.S.C. 154(b) by 42 days.

(21) Appl. No.: 16/858,612

(22) Filed: Apr. 25, 2020

(65) Prior Publication Data

US 2020/0338384 A1 Oct. 29, 2020

Related U.S. Application Data

(63) Continuation-in-part of application No. 16/394,617, filed on Apr. 25, 2019.

(51) Int. Cl.
*A63B 21/005* (2006.01)
*A63B 21/00* (2006.01)

(52) U.S. Cl.
CPC ..... *A63B 21/0058* (2013.01); *A63B 21/4029* (2015.10); *A63B 21/4033* (2015.10); *A63B 2225/09* (2013.01); *A63B 2225/102* (2013.01); *A63B 2225/20* (2013.01)

(58) Field of Classification Search
CPC ..... A63B 21/0058; A63B 21/4029; A63B 21/4033; A63B 2225/102; A63B 2225/09; A63B 2225/20; A63B 23/0405; A63B 2023/0411; A63B 23/1209; A63B 23/1227; A63B 23/1236; A63B 21/078; A63B 21/4045; A63B 71/0622; A63B 2208/0223; A63B 2208/0233; A63B 2210/50; A63B 2225/10; A63B 2225/50; A63B 2209/10; A63B 2208/0252
See application file for complete search history.

(56) References Cited

U.S. PATENT DOCUMENTS 1,064 A * 1/1839 Egleston ..... B24B 7/28 451/166
57,127 A * 8/1866 Hall ..... B21L 15/00 59/29
5,391,132 A * 2/1995 Greenwald ..... A63B 23/03533 482/114
5,527,249 A * 6/1996 Harris ..... A63B 21/068 482/57
5,625,923 A * 5/1997 Huang ..... B62B 9/20 16/429
5,935,049 A * 8/1999 Hamm ..... A63B 21/0004 482/140
6,220,995 B1 * 4/2001 Chen ..... A63B 21/02 297/175

(Continued)

*Primary Examiner* — Garrett K Atkinson
(74) *Attorney, Agent, or Firm* — Ceres Patent & Technology, LLC; Mandy L. Tran

(57) ABSTRACT

The invention herein relates to a variable weight exercise machine comprising a motor driven carriage assembly that moves along a linear path creating a variable resistant force against which the user exerts an opposite force. The chassis body and frame of said device may be positioned horizontally or vertically, and having a design that can be modularly configured in coordination with accessory elements to achieve a variety of concentric or eccentric exercise movements.

8 Claims, 19 Drawing Sheets

(56) References Cited

U.S. PATENT DOCUMENTS 6,491,611 B1 * 12/2002 Stearns ..... A63B 21/0552 297/16.1
6,551,226 B1 * 4/2003 Webber ..... F16B 7/105 403/109.3
6,726,608 B1 * 4/2004 Hsu ..... A63B 23/03575 482/121
6,752,747 B2 * 6/2004 Yu ..... A63B 21/00043 482/110
7,226,400 B1 * 6/2007 Gedeon-Janvier ... A63B 21/072 482/104
7,785,232 B2 * 8/2010 Cole ..... A63B 24/00 482/5
8,632,446 B2 * 1/2014 Solow ..... A63B 21/055 482/142
8,641,585 B2 * 2/2014 LaGree ..... A63B 22/0087 482/94
8,764,617 B2 * 7/2014 Teeter ..... A61H 1/0292 482/126
8,968,155 B2 * 3/2015 Bird ..... A63B 21/005 482/5
9,119,989 B1 * 9/2015 Lagree ..... A63B 21/02
9,474,924 B2 * 10/2016 Lagree ..... A63B 22/0046
9,522,299 B2 * 12/2016 Lagree ..... A63B 21/4029
9,579,536 B1 * 2/2017 Lagree ..... A63B 21/4035
9,586,081 B2 * 3/2017 Lagree ..... A63B 21/4001
9,597,545 B1 * 3/2017 Lagree ..... A63B 21/023
9,700,775 B2 * 7/2017 Hamilton ..... A63B 69/0002
9,717,945 B2 * 8/2017 Lagree ..... A63B 21/0407
2006/0252613 A1 * 11/2006 Barnes ..... A63B 21/068 482/95
2009/0048078 A1 * 2/2009 Marcantonio ..... A63B 23/1209 482/92
2009/0108648 A1 * 4/2009 Biggs ..... A63B 23/03575 297/217.1
2010/0279827 A1 * 11/2010 Farnsworth ..... A63B 22/02 482/54
2013/0203569 A1 * 8/2013 Athis ..... A63B 21/00 482/142
2014/0038792 A1 * 2/2014 Farnsworth ..... A63B 22/02 482/112
2015/0057127 A1 * 2/2015 Lagree ..... A63B 21/00 482/4
2015/0165293 A1 * 6/2015 Hamilton ..... A63B 69/0059 473/453
2015/0367166 A1 * 12/2015 Lagree ..... A63B 21/15 482/123
2016/0256733 A1 * 9/2016 Lagree ..... A63B 22/0087
2017/0001064 A1 * 1/2017 Vorozilchak ..... A63B 21/4029
2017/0036057 A1 * 2/2017 Lagree ..... A63B 21/40
2017/0072252 A1 * 3/2017 Lagree ..... A63B 22/0087
2017/0100625 A1 * 4/2017 Lagree ..... A63B 21/02
2017/0189740 A1 * 7/2017 Lagree ..... A63B 22/0089
2018/0093125 A1 * 4/2018 Johnson ..... A63B 23/0464
2019/0255377 A1 * 8/2019 Aronson ..... A63B 21/4045

* cited by examiner

MOTOR-DRIVEN VARIABLE WEIGHT EXERCISE DEVICE WITH MODULAR CHASSIS BODY

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

CROSS REFERENCES

This application is a continuation-in-part utility patent application claiming benefit of priority to and incorporating by reference in full the nonprovisional patent application Ser. No. 16/394,617, filed Apr. 25, 2019, in accordance with 35 U.S.C. § 119.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

Field of the Invention

The present inventive subject matter relates to a device, method, and system for a variable exercise machine having a variable linear carriage held within a unitary chassis body and frame.

Background

Portable exercise machines of the existing art have traditionally been designed with individual methods of exercise in mind. In the realm of concentric and eccentric exercises by way of weight machines, such devices have been designed for purchase or use among a commercial market or individual retail market. In the commercial realm, for example private health clubs where machinery is shared by a community of users, it had been preferable for each machine to have limited but defined purpose and design. It is not uncommon in these shared environments to find a variety of machines, each for a specialized method of exercise. The diversity and plurality of exercise options allow users to share equipment interchangeably without monopolizing space for too long. Machines or devices in the commercial context tend to be larger and heavier as well in order to sustain long term and extensive usage by many different people. The interest to sustain extensive long-term heavy usage in the commercial setting directs design towards machinery with heavier gauge and limited configurations.

Few weight machines have been designed with an equivalent durability for the individual retail market. In part, this is due to the fact that product distribution at the individual retail level is affected by product weight and size. Lighter weight designs are preferred simply to enable sales and distribution within the market. Slimness in design is also another preferred feature to accommodate spatial limitations of standard residential homes. The size and weight limitations of personal gym equipment often make them less durable for the desired level of exercise sought by the user. Dimensional and weight restrictions further make it difficult to achieve adjustable configurations among at home exercise machines.

U.S. Pat. Nos. 8,388,499 and 8,105,206 disclose two variable weight exercise machines containing a carriage moved along a linear path by screw mechanism that is motor driven. These devices are designed primarily for commercial use. They cannot be reconfigured and are limited in modes of exercise. U.S. Pat. No. 7,892,159 discloses a device having a central screw element attached to a motor drive system with parallel support rails for transport of a device along a linear path. Similarly, this device is non-adjustable in its configuration and provides a very slim design that may not safely or effectively endure extensive usage even in a home environment.

There remains a need in the art for a weight machine that can be accessible to a residential market by offer of a lighter weight frame (compared to commercial machines) yet having the stability and durability of a commercial machine, but offering a variety of exercise modes and variable weight challenges all within a single frame system.

SUMMARY OF THE INVENTION

The inventor herein has developed a new form of a variable weight exercise machine comprising a motor driven carriage assembly that moves along a linear path creating a variable resistant force against which the user exerts an opposite force. From the broadest context, the device comprising a unitary chassis body and frame containing a motor driven linear actuator capable of moving between variable locations along its linear path. Said motor driven linear actuator system having a carriage element thereon that is connectable to a plurality of elements that extend beyond the chassis body, interacting with the user. The chassis body and frame having a design that can be modularly configured in coordination with said carriage element, enabling a plurality of horizontal, vertical, or angular concentric or eccentric exercise movements. The material composition of said frame and extension elements of this invention should comprise durable hard material such as metal including without limitations, steel or aluminum, which can withstand the force of the user against the motorized linear actuator.

General Description of the Device

The various embodiments that is contemplated within the scope of this invention do have several component features in common. To begin, the exercise sought to be achieved by this invention is concentric and eccentric muscle action against a variable forward or rearward force. The variable forward and rearward force, which in traditional machines comprise tangible heavy weights of metal material, is instead created by a mechanical source within this invention. A motorized linear actuator system is held within a chassis frame that allows for coordination of a variety of exercise options therefrom. Additional attachments and accessories are contemplated within the scope of this invention which further maximizes or expands the variety of exercise options and directional motions achievable by the core features of this invention. The core feature of this invention mainly comprising a motorized linear actuator system held within an enabling chassis frame and positionable relative to a variety of attachments and accessories. The chassis frame and actuator system may be positioned vertically or horizontally to achieve any choice type of exercise. The system in its entirety is meant to be modular in nature. Modularity of this device would refer to a variety of achievable modular design which enables a variety of exercise options by those such designs. Modularity of this inventive device and system comprising the ability of the chassis frame (which holds the linear actuator system) to be detachably connected to the various accessories, attachments, subframe components by manner of pin connection. The various components of this invention have strategically placed perforations through opposing sides of their surfaces (front, rear, first and second sides, top and bottom) to allow for interconnection of components at strategic locations by sleeving pins snuggly therethrough, holding multiple components together in sturdy secure manner. The pins may serve a variety of roles beyond providing sturdy interconnection. In some cases, the pins may extend further outward to provide a location of leverage. The leverage may serve use for the user's body (i.e. a foot rest) or for enabling certain functions of an attached accessory (i.e. forming part of a pully system, etc.).

The motorized linear actuator system of this invention comprising a motor and a threaded linear screw drive to create both forward or rearward force. The motorized linear actuator system is securely held internally within the chassis frame at its either end, but preferably the end that is positioned closest to the ground surface when the chassis frame is seated in a vertical position. Depending on whether the chassis is in a vertical or horizontal position, the forward and rearward force within the chassis may be expressed in vertical up and down force or horizontal forward and backwards force. Since this is a mechanically driven force, it will nearly overpower the user in every case. As such, the quality of exercise experienced by the user would depend on how long the user can endure against the movement of the actuator by the user's opposing action.

An alternative embodiment of the motorized linear actuator system may comprise a motor drive attached to one or more rotating circular belts, each said belt of said one or more rotating circular belts rotatable along the length of said chassis frame, each traveling along a guide track (alternatively referable as a guide channel) along either side of said chassis frame in parallel manner. Said belts in this case is preferably a durable material able to withstand the force exerted thereon, such as metal chain.

Alternatively, said motorized linear actuator system drive system may comprise one or more threaded screw drives, said one or more threaded screw drives held within a guide channel or guide track either centrally along the chassis frame or along either side of said chassis frame. The directional movement of each threaded screw drive (clockwise versus counter-clockwise rotation) is determined by a motorized drive system. If it is intended for two or more threaded screw drives to rotate in opposing directions, then each said directional movement will require its own separate motor drive connection to control each separate directional movement.

Yet another embodiment of the invention comprising a single threaded screw drive centrally positioned along the length of said chassis frame, wherein said threaded screw drive is connected to a carriage thereon which travels along the length of said chassis frame. Said carriage may further be supported on either its right or left sides, or both sides, with rollers that traverse two opposing parallel guide tracks along the length of said chassis frame. The carriage element of this invention as described herein comprises a platform that attaches directly to the threaded screw drive, protruding beyond the actuator system and external to the chassis frame, forming the portion of the device that interacts with the user either directly (i.e. a seat) or by means of an attached accessory (i.e. chain extension, handle, or foot peddle).

The carriage element of this device provides a platform that is attachable to additional tools or platforms which interfaces directly with the user. The tools may comprise without limitations wires, chains, or additional frame elements, all of which are intended to be moved and driven by said drive system and carriage element. The external platform attachable to said carriage element may comprise a seat that carries a user seated thereon. Alternatively, the external platform may comprise a vertical frame extendable from said carriage above said chassis frame such that said vertical frame may be moved to variable locations along the length of said horizontal chassis frame. Said vertical frame extension may comprise a vertically positioned panel or plate having a planar surface (also referable herein as a vertical panel). The user would be seated on a stationary (nonmoving) platform while exerting force against said planar surface of said vertically positioned plate which moves along the length of said chassis frame.

Said carriage element may further provide connection means that allow a length of flexible and durable exercise strap to be attached to said carriage element, the farther portion of said strap looping through or around a leveraging mean (i.e. an eye hook, J hook, cross-bar, etc.) such that when the strap is pulled by said carriage at its first end, said strap is leveraged against said leveraging means and pulls away from the user seated on an external platform (i.e. seat) that is also attached to and above said carriage element. The leveraging means may in fact be positioned at any location along the chassis frame or extensions therefrom to allow for variable angular bodily exercises and movements by pulling against a strap element. Said leveraging means may comprise perforations cut through said chassis frame wherein said straps would loop therethrough. Alternatively, said leveraging means may comprise looping means (i.e. eye hooks or J hooks) that are either permanently attached or removably attachable to any location on said chassis frame or said extensions therefrom. Said leveraging means may also comprise cross-bars that extend from said chassis frame. Said cross-bars may be permanently attached or alternatively be created by sleeving a thick diameter pin through matching perforations of said chassis frame where in the pins extend outward on either right and left sides (alternatively referable as first and second sides) of the chassis frame to provide sufficient surface area for such leverage. Said leveraging means importantly must be securely connectable to said chassis frame or extensions therefrom to not dislodge against an exerted force, may have loose straps sleeve therethrough or therearound, and allows for sliding movement of said straps therethrough or therearound. The external tools, external platforms, perforations, and other such leveraging means are removably attachable to said carriage to enable variable exercise options thereon, for ease of storage, and for ease in packaging for improved transport.

A more specific embodiment of the invention provides for a variable load resistant exercise machine that is enabled by a motor-driven linear load transfer system contained within a singular chassis frame and body that is capable of modular configurations. The linear load transfer system comprising a linear actuator such as a threaded screw drive mechanism connected to a motor drive. Said threaded screw drive being centrally disposed within said chassis along its length. Said threaded screw drive further connected to a chassis element that traverses the length of said threaded screw drive in variable manner in terms of speed and locational position. Said carriage element further stabilized on either side by rollers or wheels that traverse along parallel guide tracks along the length of said chassis to its right and left sides. By this invention, the chassis comprise a long horizontal frame that is lower to the ground and provides a wider and lower center of gravity for the user seated thereon. The two parallel guide tracks along the length and sides of the chassis helps to balance and stabilize the shifting weight of a user seated thereon. The parallel guide tracks provide stable support for directional movement of the carriage along the length of the body and spreads the weight of the device and user across a wider surface area. The motor drive and linear transfer element may be manually, digitally, or electronically controllable by direct or remote communication through sensing elements. A digital panel containing preconfigured software language is connectable to said device of this invention, receiving user related electrical input from said device that is translatable into performance data that is viewable and readable from said device panel. A typical load cell transducer may be used to translate the force experienced by the user into standard signal and readable data for this purpose. Alternatively, the force of the machine as experienced by the user may be measured directly from the motor drive by manner of mathematical calculations. The received electrical signal data from the load cell transducer would be digitally translated within the computer system of the device. While alternatively, the draw of force from the motor may be mathematically calculated by the computer system by preconfigured algorithmic means more directly (without need of a transducer element) based on the known qualities of the motor and its variable functions. This alternative manner of reading force is achievable by reading directly the draw of force from the motor because unlike any prior machine within the industry, the user according to this invention is directly engaging in exercise against the raw force of the motor. As such, a measure of the draw of force from the motor serves as reliable data on user exercise input and output. Said viewable digital panel is an optional feature to this invention and may be detachable for a more basic model of the device. Because the device operates by an electrical motor drive system, it is feasible to control the device by push button means either directly or remotely. Remote control may be achieved by any wireless digital, electrical, or radio signal system such as a key-fob device.

The body of this device having strategic perforations on its sides along its length to allow pin or cross-bar elements to be sleeved through at prescribed locations for additional user options. According to the summary and description of this invention, the term cross-bar element and pin are used interchangeably as being a metal rod that sleeves through perforations of the device, its subframe components, accessories, and any attachments. Both terms describe the effect of interconnecting the various components together with the potential of serving additional function such as leverage. At least one or more pin element is sleevable through the cross-section of said chassis to maintain structural integrity of the device. The pin element helps to prevent warping of the chassis frame, which otherwise would cause a loss of parallel positioning of said parallel guard rails and thus block linear transfer. The pin element may terminate in a fixed (i.e bolted) manner at the side surface of said chassis in flush manner or alternatively extend beyond the side surfaces of said chassis in removable manner, outward towards the external environment. By extending externally beyond the surface of said chassis, the user may utilize the extended portion of the pin element as leverage. The extended pin element may either serve as a leveraging means whereby straps may wrap therearound for a pulling exercise. It may alternatively serve as foot rest for the user, leveraging the user's lower body against opposing weights.

Additional pin elements may relate to a back rest element. Said back rest element being hingely attached to the top of said chassis and is able to toggle or swivel forwards and backwards, ultimately resting against the pin element. The side surfaces along the body of said chassis having strategically placed perforations would allow said pin element to be sleeved through a location either frontward or rearward of said back rest in either its forward or rearward position, creating a forward or rearward seating option on said chassis. When said pin element is removed away from the back-support element, the back-rest element would decline fully to a horizontal position overtop said chassis. Said back-rest element also allowing for detachable connection of cushion elements to be held thereon for comfortable use and seating. Said cushion elements may be detachably connectable to said back-rest element by hook and loop means or any other known sturdy and detachable methods of connection.

The device of this invention further providing handle elements. Said handle elements preferably comprising two parallel bars extending horizontally from said vertical frame extension from a right and left side towards the chassis frame. Said two parallel bars terminating with either a handle element. Said handle element may comprise a simple linear grip element (i.e. a vertically disposed round pole) or alternatively a circular ball-gripping element. Said linear gripping element would require a fisted grip therearound. Said ball-gripping element may comprise a smooth ball shaped component where it's top half circumference may be substantially or fully gripped by an adult hand. The round shape of a ball shaped grip component allows a controlled grip of the handle without a fisted hold. This is important to certain individuals who may suffer muscular or nerve damage in their hands. The rounded feature also allows for much easier repositioning of a hand grip during exercise by a sliding movement of the hand grip thereover.

Vertical & Horizontal Dual Axis Embodiment

Yet another embodiment of this invention that encompasses all of the above described features and embodiments provides for a pivotable chassis which may be pivoted between a horizontal position to and from a vertical position for dual axis exercise options. By this embodiment, a support frame is provided along the horizontal axis to provide leverage and connection to the chassis when it is rotated to a vertical position. The motor and drive components held within the chassis as described in the above general descriptions would preferably be positioned at a first end of this invention such that when the device is rotated upright in vertical manner, the motor and drive elements within the first end would be positioned furthest from the ground level. The second end of the chassis will serve as the point of rotation such that the chassis would be able to pivot from its horizontal position at the ground level to an upright vertical position by lifting and rotating the device within 90 degrees at its second end, the second end serving as the point of axis. The device may similarly be lowered to its horizontal position by rotating the device within 90 degrees downward at it the second end, serving as the pivot point. The mechanical components of the chassis are therefore held within that lower half of the chassis closest to the second end. The drive element, preferably a linear screw drive element, would be vertically positioned in linear manner such that by action of the motor will cause an upward and downward movement of attachments connected to said linear screw drive element in threaded manner.

The support frame of this alternative embodiment comprising a horizontal frame that is seated along the ground surface and connectable to the second end of the chassis at its first end. The connection between the first end of the support frame and the second end of the chassis comprising a detachable bridge (which serves as a gusset and referred interchangeably to as a gusset) having perforations therethrough such that the location of perforations on said gusset is in matching location to perforations along the second end of said chassis between its first and second (or right and left) sides and at matching ends of the first end of the support frame between its first and second (or right and left) sides as well. A heavy gauged linear pin, which comprises metal bar or rod, is sleeved through the matching holes of the gusset and chassis and at matching holes of the gusset and support frame to create a leverage between the support frame and the chassis. This leverage connection comprising a gusset connection as described at both first and second sides of the chassis and the support frame with a common linear bar (alternatively referred to as a pin) connection therethrough. The gusset pieces are in tangential relationship between the vertical axis of the chassis and the horizontal axis of the support frame.

The support frame comprising two lengths of parallel bars each in adjacent contact with the first and second sides of the second end of the vertically positioned chassis. The space between each said parallel bars of the support frame to have the same or substantially similar width of the chassis frame such that the second end of the chassis frame is snuggly seated therebetween. The length of this horizontal extension of the support frame by its parallel bars facing an exposed side of the chassis frame where the screw drive held therein may be connected to an accessory that extends outward towards a user who is positioned above the support frame either in seated or standing position. These two parallel bars extend further beyond the second end of the chassis frame to be in a perpendicular position from the vertically positioned chassis frame.

The parallel bars of the support frame are interconnected by pins that sleeve though matching perforations within the parallel bars. A first pin is sleeved though a first end of a first parallel bar, then through a perforation at the bottom end of a first gusset element, and through a matching perforation at the first end of a second parallel bar. A second pin is sleeved through matching perforations between the first parallel bar, the first and second sides of a first corner of the second end of the vertically positioned chassis, and through the second parallel bar. A third pin is sleeved through the matching perforations between the first parallel bar, the first and second ends of a second corner of the second end of the vertically positioned chassis, and through the second parallel bar. A fourth pin is sleeved through the matching perforations of the second end of said parallel bars. More pins may be added as needed for support or leverage.

The invention herein further providing accessory components that are removably detachable or adjacently positionable to enable a variety of exercises. According to the preferred embodiment of this invention, a detachable sub-frame component comprising two shorter parallel bars, each parallel bar being a mirror design of the other. Each parallel bar of said sub-frame component having a variety perpendicular extensions. The perpendicular extension may comprise a foot pedal or a leverage bar attached to its first end located closest to the chassis when positioned alongside the support frame. When each of the two sub-frame components are positioned at either side of the support frame, it forms support and leverage features for added variety to the user's exercise options. Other attachments may be interconnected between the short parallel bars of the sub-frame component and the support frame, such as a vertical handle comprising a stand-alone vertical bar positioned adjacently to either of said short parallel bars and connected in place by a pin. The vertical handle may be positioned at a variety of angles above the ground surface by resting its bottom end between a first and second pin where said first and second pin are angularly positioned relative to the other. According to a preferred embodiment herein, a detachable bench may be positioned over the support frame to enable stable seating and leveraged exercises.

Modular Frame System

Yet another aspect of the invention herein comprising the greater feature of its modular frame. The invention herein comprising a portable at-home multi-faceted exercise machine that enables a wide variety of vertical and horizontal concentric and eccentric weight exercises by an enabling modular feature. The enabling modular feature of this invention comprising a series of perforations located along the surface of the frame components, chassis, and accessory components. The perforations are strategically placed along the surface of each accessory component, frame components, and chassis, to be sleeved completely through at matching locations by pin elements to create an interconnection between them. The pin elements preferably comprising hard durable metal material of a preferred diameter to endure the amount of torque or weight that it must maintain during repetitive exercise. The pin elements may have a smooth surface along its length or alternatively be threaded for attachment of a threaded nut for enhanced security and sturdiness. The diameter of the pin element should be substantially the diameter of the particular perforation hole that it is intended to be sleeved through for a secure sturdy and tight connection. It is the intention that the connection of each pin with its respective various perforations be tight enough to not easily slide apart during use, to avoid rattling of the inventive device, and for the overall structural integrity of the entire device in its assembled form during use to be tightly connected. The various embodiments that falls within the scope of this invention is shown and described low in the detailed descriptions and within the drawings, but is not limited to what is presented herein but may include other embodiments not described but do otherwise exercise the broadest features and intentions of this invention.

Methods of Use

The device of this invention providing a variety of modular components which can either be repositioned or detachably connectable in different configurations for a variety of exercise movements. The preferred embodiment of this device may achieve the following variety of focused weight exercises: 1) chest exercises, 2) back exercises, 3) arm exercises, 4) shoulder exercises, 5) quadricep exercises, 6) hamstring exercises, 7) bicep exercises, 8) and tricep exercises. Specific types of exercise motions may comprise the following without limitations: 1) leg press, 2) row, 3) squat, 4) curl, 5) pull down, 6) chess press, 7) bench dip, 8) abdominal crunch. Other exercise motions not otherwise listed here are achievable by simple reconfiguration of the device herein. The detailed descriptions below together with the attached illustrations will provide examples of the various methods of exercise achievable by various modular arrangements of this invention according to its modular design.

DETAILED DESCRIPTION OF THE DRAWINGS

The present invention is best understood by reference to the detailed figures and description set forth herein. Embodiments of the invention are discussed below with reference to the Figures. However, those skilled in the art will readily appreciate that the detailed description given herein with respect to these figures which is for explanatory purposes as the invention extends beyond these limited embodiments. It is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be understood that any exact measurements, dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

The present invention will now be described in detail with reference to embodiments thereof as illustrated in the accompanying drawings.

The invention herein specifically comprising the following elements, as illustrated in part by the referenced figures. The illustrations and figures herein serve to explain certain aspects of the described invention and should not be read to limit the scope of this invention. Other embodiments will be understood to be within the scope of this invention according to the description provided herein.

Figure 1:
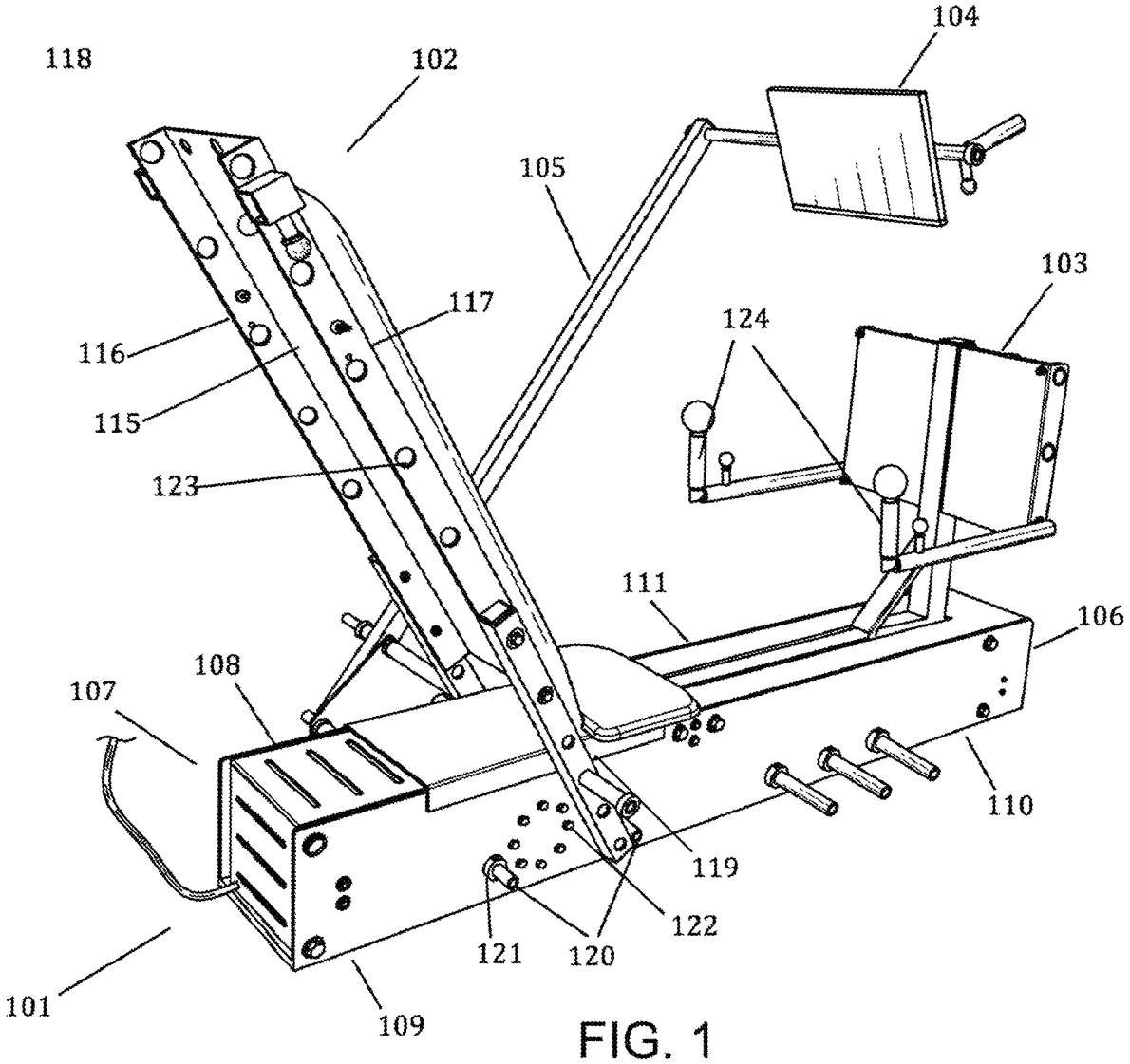
FIG. 1 provides a right side perspective view of the invention according to a preferred embodiment as illustrated.
Figure 2:
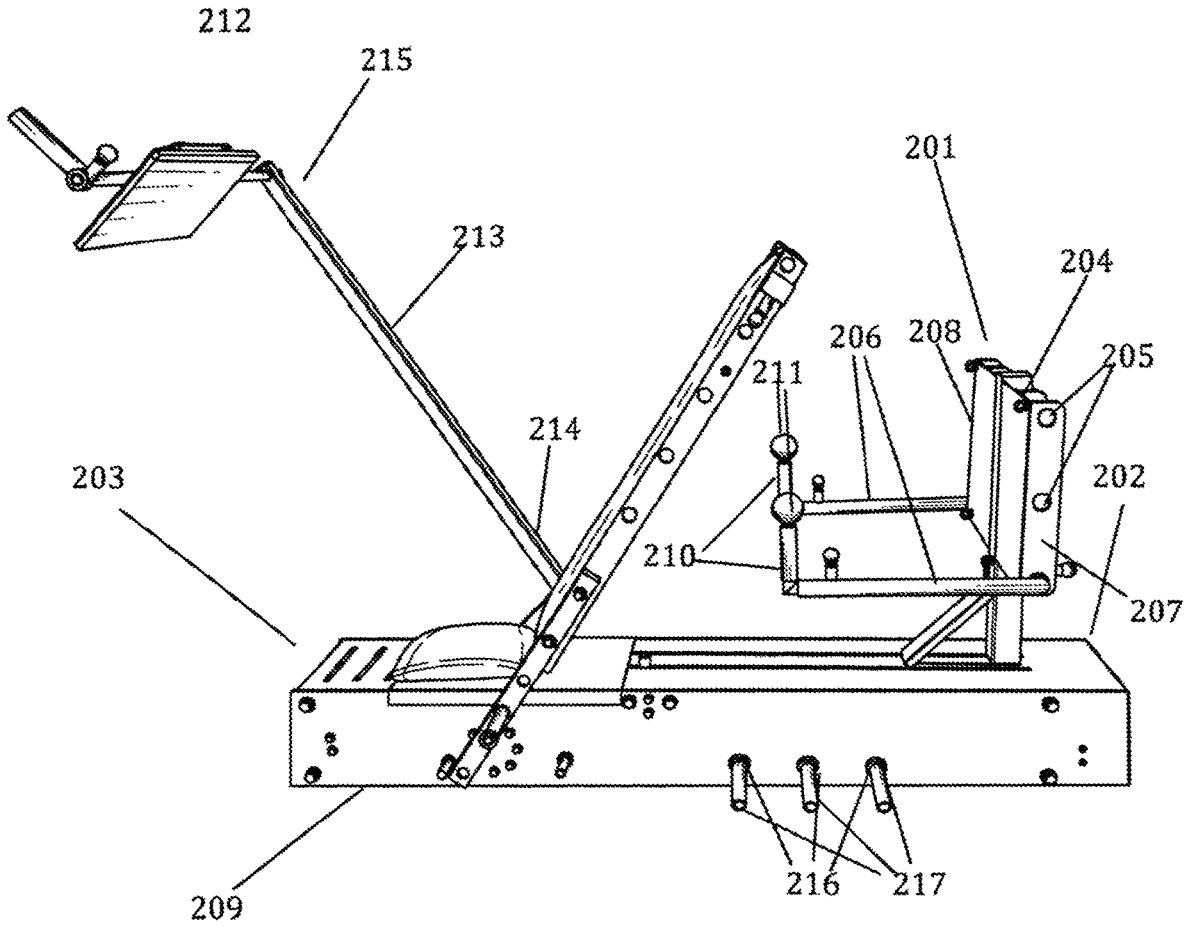
FIG. 2 provides a right side perspective view of the invention according to a preferred embodiment as illustrated.

The device of this invention according to a preferred embodiment as illustrated in FIGS. 1 through 4, specifically as shown in FIGS. 1 and 2, comprises the following elements: A hollow geometrically shaped body horizontally (also referred to as the chassis frame) 101 disposed and seatable on a ground surface, a rotatable resting element 102, a vertical platform 103, and optionally a digital panel 104 attached to a rotatable digital panel arm 105. Said hollow geometrically shaped body or alternatively referenced as chassis frame or chassis body 101 having a front 106, rear 107, top 108, bottom 109, right 110, and left side 111 surfaces. Said top 108, bottom 109, right 110, and left 111 sides surfaces forming the length of the device which is longer than its said cross-sectional width, in total having a substantially rectangular shape. The length of said chassis frame may be any length but is preferably 6.5 feet long (78 inches) or alternatively a preferred length of under 8 feet long. The height of side surfaces may be up to 36 inches but is preferably 11 inches tall according to the preferred embodiment of this invention. Said front 106, rear 107, top 108, bottom 109, right 110, and left 111 side surfaces having an external surface 112 facing the external environment and an internal surface facing the internal space within said hollow geometrically shaped body 101. The width of said top 108 and bottom 109 surfaces may be up to 36 inches wide but is preferably 13 inches wide according to the preferred embodiment of this invention. Said hollow geometrically shaped body 101, comprising said front 106, rear 107, top 108, bottom 109, right 110, and left 111 side surfaces of this preferred embodiment comprising the chassis body (or alternatively referred to as the chassis frame) 101 of this invention.

Said rotatable resting element 102 comprising a planar panel 115 of substantially similar cross-sectional width as said top surface 108 of said chassis frame 101 and rearwardly disposed within the rear half along the length of said chassis frame 101. Said planar panel 115 of said resting element 102 having a length that is greater than its width. Said length comprising a left 116 and right side 117 parallel to the left 111 and right 110 sides of said chassis frame. Said planar panel 115 terminating at a top 118 and bottom 119 side. Said top side 118 of said planar panel element 115 terminating beyond the rear end 107 of said chassis frame 101 while the bottom end 119 terminates within the rearward half of said top surface of said chassis frame 101. A rotating mechanism comprising a bar 120 sleeved through perforations 121 along the left 111 and right 110 side surfaces of said chassis frame 101. Said planar panel 115 rotatable along a vertical path over the top side surface 108 of said chassis frame 101 within a substantially 180 degrees rotation.

Said chassis frame according to a preferred embodiment of this invention according to FIGS. 1 and 2 having perforations therethrough between its right 110 and left 111 side surfaces in matching form, dimension, and design to each enable a narrow pipe or bar to snuggly fit or sleeve therethrough in straight perpendicular manner between said right 110 and left 111 side surfaces. The perforations may comprise any pattern but should sufficiently match and mirror each other between said right 110 and left 111 sides to enable any pin element to fit therethrough in substantially horizontal fashion, whether or not perpendicular in nature. The additional purpose of having perforations throughout the chassis frame is to remove excess weight without harming the structural integrity and sturdiness of the frame. This is highly beneficial for purposes of achieving lower cost in shipping and distribution of the inventive device to customers.

The purpose for fitting a bar through the chassis frame 101 between said left 111 and right 110 side surfaces is to create additional leverage, repositioning of parts, or introduction of additional tool elements. For example, as shown in FIGS. 1 and 2, pin elements 120 located along the bottom rearward half of said chassis frame serves to block rotation of said resting element 102, allowing the resting element 102 to maintain a substantially vertical position. Depending on the position of said pin element 120, the resting element 102 may be disposed in a forward direction or rearward direction. A forwardly angled vertical position of said resting element 102 creates a back rest for the user who may be seated facing rearward on said chassis frame 101. Likewise, a rearwardly angled vertical position of said resting element 102 creates a back rest for the user who may be seated facing forward on said chassis frame 101. According to a preferred embodiment of this invention, a radially disposed series 122 or plurality of perforations are provided directly below the bottom side of said planar panel along the right 110 and left 111 side surfaces of said chassis, allowing for angular adjustment of the vertical positioning of said planar panel 115. The diameter or length of each perforation of said radially disposed series 122 of perforation is preferably 0.375 inches, but may be any greater or lesser diameter to achieve its intended purpose. Larger circular perforations 123 are preferably up to 1.76 inches in diameter. Even further, perforations may comprise any geometric shape and may have a length or diameter up to the width, height, or length of said chassis body to serve any variety of functional or aesthetic purposes as described herein.

Figure 3:
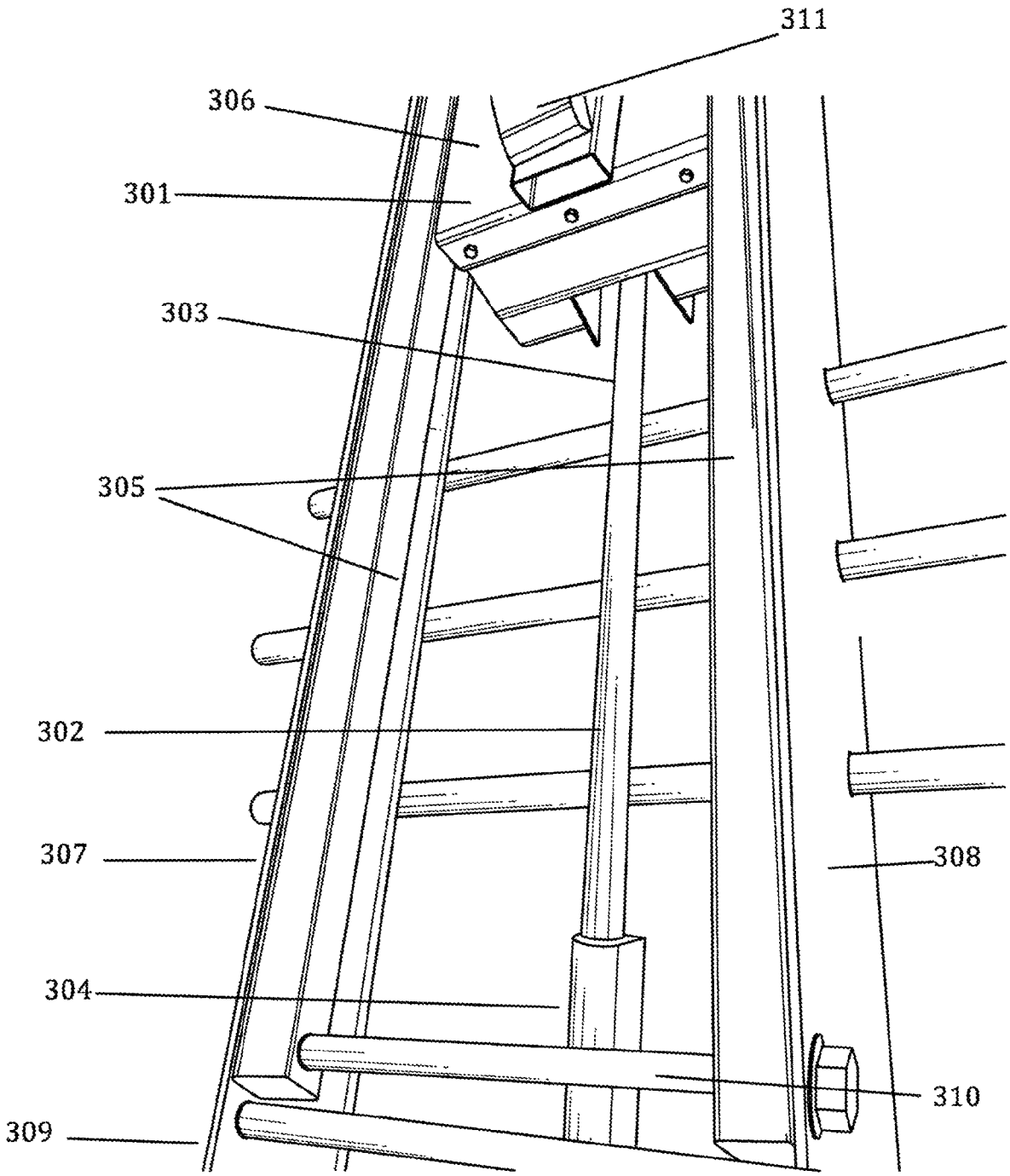
FIG. 3 provides a partial top perspective view of the internal rear end portion of the invention according to a preferred embodiment of this invention.
Figure 4:
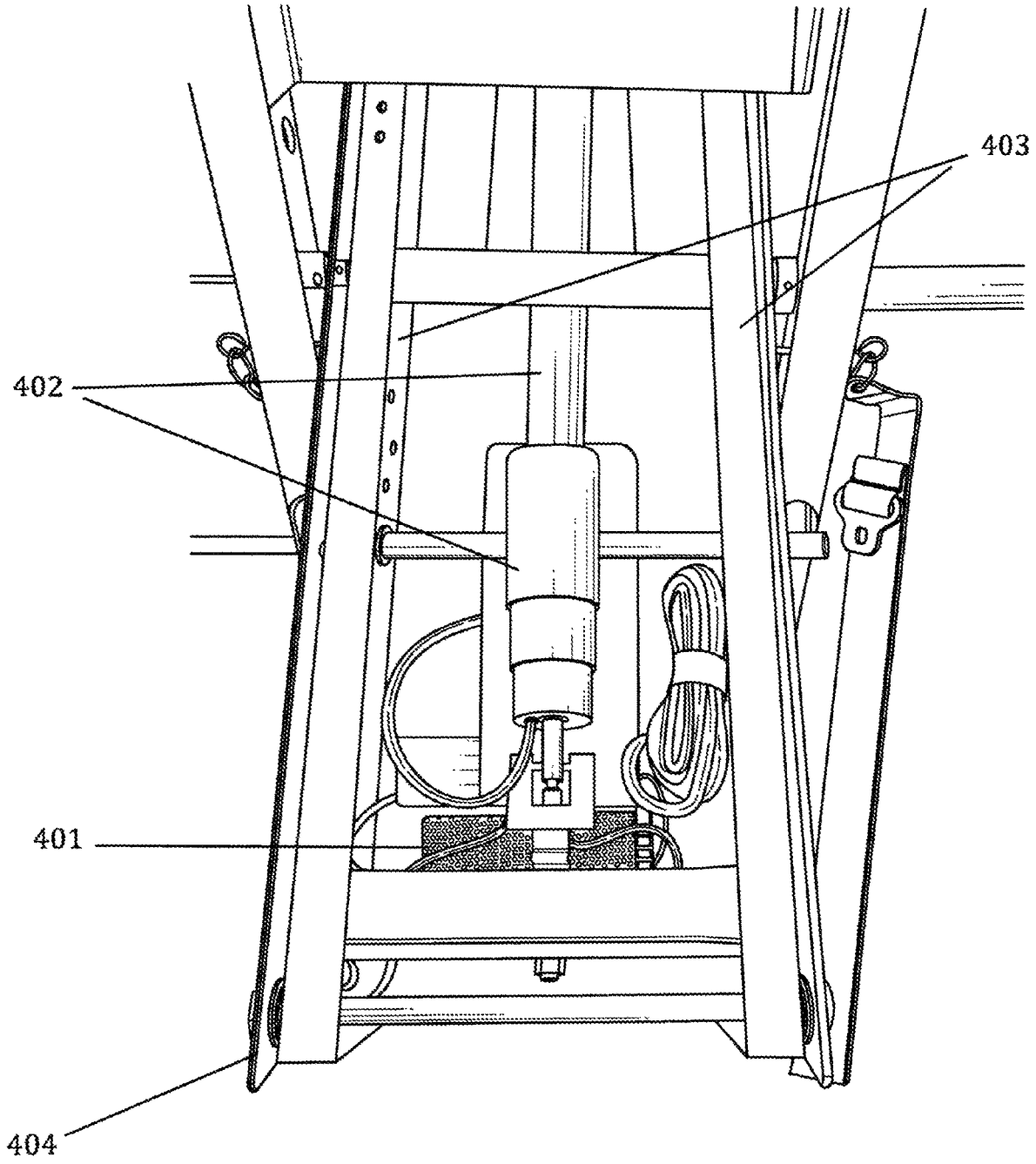
FIG. 4 provides a partial top perspective view of the internal front end portion of the invention according to a preferred embodiment of this invention.

The internal space of said chassis frame according to FIGS. 3 and 4 of the preferred embodiment containing the following elements: A motor drive 401, a linear actuator 402 which may comprise a threaded screw element, two parallel guide tracks 403, a carriage 301 seated over said two parallel guide tracks 403. Said linear actuator 402 comprising a length of threaded screw with any preferred length between one (1) to 5 (five) feet, said linear actuator 402 being disposed centrally along the front half of said chassis frame 404. Said linear actuator 302 having a first end 303 closer to the front end of said chassis frame and a second end farther 304 away from the front end of said chassis frame. Said linear actuator 402 connected to a motor drive 401 wherein said motor drive 401 is electrically driven to rotate in two opposing directions by threaded screw element. The driven movement of said motor drive 401 causing said threaded screw element 402 to rotate in either of two opposing direction. A carriage 301 is detachably connected to said linear actuator 402 at the lower end of said carriage 301. Said connection may be by threaded screw and bolt connection, hook style connection, clip style connection, pneumatic style connection, or any known means for a removable and secure positioning of said carriage 301 on said linear actuator 302 wherein said carriage is rollably seated on either said two parallel guide tracks 305. The top surface 306 of said carriage element 301 is further attachable to optional tools by detachable connection means (i.e. threaded screw means, clamping means, hook means, etc.). Said optional tools extending beyond the top or external surfaces of said chassis frame from said carriage 301 and interacts with the user by being moved in either a forward or rearward direction along the front half of said chassis frame.

Said carriage element 301 further having roller elements (not shown in the illustrations) on its left 307 and right 308 sides that each rests within a guide track 305 along the internal right and left surfaces of said chassis frame 309. Said carriage element 301 traveling along said centrally disposed linear actuator 302 and stabilized by roller elements fitted within each said right and left side of said two parallel guide tracks 305, traversing smoothly in either forward or rearward direction along the length of said chassis frame 309. Said two parallel guide tracks 305 at either right and left sides of said chassis frame 309 positioned in parallel manner with said chassis frame 309 and with said centrally disposed linear guide track 302 such that the parallel relationship enables a smooth and straight directional movement along the entire length of said linear actuator 302 by said carriage element 301. To facilitate smooth traversal along the length of said chassis frame and threaded screw drive of said linear actuator, a cross-bar 310 is fixedly attached at the rearward end of said two parallel guide track 305 across the cross-section of said chassis frame 309 to maintain the two parallel guide tracks 305 in fixed parallel position. This is especially important in lieu of high amount of usage by multiple different users or alternatively shifting weight of the user seated thereon, which could throw off parallel alignment of the guide tracks 305. A loss of parallel alignment of the two parallel guide tracks 305 would otherwise cause the traversal movement of the rollers along the guide track to seize. The cross-bar 310 in this case would serve to hold the two parallel guide tracks 305 in fixed parallel position in spite of pressures thereon and will further serve to block continued traversal of said carriage 301 beyond and past the terminal end of said two parallel guide tracks 305.

According to the preferred embodiment of this invention, a vertical panel 311 is removably connected to said carriage element 301, extending above the top surface 306 of said chassis frame 301 in perpendicular manner. As further shown in FIGS. 1 and 2, said vertical panel 201 having a front 202 and rear side 203. Said front side 202 of said vertical panel 201 facing towards the rearward direction of said chassis frame. Said front side 202 of said vertical panel 201 further being flat and planar and is of rigid construct. The vertical panel 201 in this case provides sufficient surface space to allow a user to position their legs in a substantially upward and horizontal position, pushing against said vertical panel as it is moving towards the user who is in a seated position. The rear side 203 as well as the perimeter edge 204 of said vertical panel 201 may further have hook elements attached thereto or alternatively, perforations 205 therethrough, that allows straps to be connected or sleeved through. The straps would be pulled away with the vertical panel 201 allowing the user to accomplish stretching exercises. The vertical panel 201 is removably connected to said carriage and may be removed at any time. Said carriage may be interchangeably connected to any other extension elements, including without limitations poles, hooks, seating elements, etc.

The vertical panel according to a preferred embodiment of this invention as shown in FIGS. 1 and 2 further having two arm extensions 206, each arm extension of said two arm extensions 206 attached to either the right 207 or left side 208 of said vertical panel 201 and protruding towards the rear side 208 of said chassis frame 209. Said arm extension 206 terminating with a substantially perpendicular L shaped bend or L-attachment 210. Said L shaped bend or L-attachment 210 creating a handle element for a fisted grip therearound. Said L shaped bend or L-attachment 210 is detachably connectable to each said arm extension 206 and may be radially adjusted for a preferred gripping position. Further, said L shaped bend or L-attachment 210 may allow for attachment of an additional gripping element. Said additional gripping element 211 of the preferred embodiment of this invention comprising a round or ball-shaped gripping element 211 that is removably attachable to said L shaped bend or L-attachment 210. Said ball-shaped gripping element 211 having size substantially equal to or smaller than the size of an adult human user's hand such that the user's hand may comfortably hold onto said ball-shaped gripping element and comfortably adjust position thereon.

The preferred embodiment of this invention as shown in FIGS. 1 and 2 further providing the optional element of a digital panel 212. Said digital panel 212 connectable to a rotatable bar 213 that extends at a vertical angle in an upward and forward direction from said chassis frame 209. Said rotatable bar 213 may be disposed at an angle towards the front or rear end of said chassis frame 209. Said rotatable bar 213 having a bottom end 214 attached to said chassis frame 209 and a top end 215 terminating above said chassis frame 209, said top end 215 connectable to said digital panel 212. Said rotatable bar 213 having a length that extends beyond the height of said chassis frame 209 to be viewable at eye level or above eye level by said user in seated position on said chassis frame 209. Said digital panel 213 being connectable to the top end 215 of said rotatable bar 213 or anywhere along the top half of said rotatable bar 213 such that said digital panel 212 is viewable by said user in either forward or rearward seated position by rotation of said rotatable bar 212 at a forward or rearward angle on said chassis frame 209. Information from said motor drive is translated into digital signals and receivable by said digital panel for further configuration into viewable and readable information regarding the user's performance metrics.

The preferred embodiment of this invention further providing additional perforations 216 along bottom edge of the right and left side surfaces of said chassis frame 209. Said perforations allowing for cross bars 217 to be removably sleevable there through and extending beyond the right and left side surfaces, serving as a foot rest or foot leverage 217 for the user.

The overall weight of the device according to the preferred embodiment described herein and as illustrated is as follows: said chassis frame comprising the front, rear, left side, right side, top side, and bottom side surfaces with perforations as illustrated including said internal components of the linear actuator and motor drive system having an approximate weight of 150 pounds. Said carriage element including the vertical panel comprising approximately 60 pounds. Said back rest element including perforations and cushion elements as illustrated having a total weight of approximately 20 pounds. Said digital panel with arm extension having a total weight of approximately 8 pounds. The total weight of the device described herein as illustrated is approximately 250 pounds. The total surface area of all said perforations disposed along the surfaces of said chassis frame, said rotatable resting element, and said external platform is at least 0.5% or above the cumulative surface area of said chassis frame, rotatable resting element, and external platform.

Additional embodiments by way of perforations, connections, extensions, or attachments that enables additional optional configurations to the device herein, not otherwise shown in the illustrations or otherwise explicitly described herein, remains within the contemplated scope of this invention. The contemplated scope of this invention comprising a single unitary device that is adjustable to a plurality of configurations that enables full range and full body concentric and eccentric exercises by manner of a variable motor driven resistance force.

The types of exercises contemplated by this invention comprising those described herein without limitations and may include additional exercise options not otherwise disclosed but falling within the scope of this invention as described herein. FIG. 1 provides illustration of the chassis body 101 with the back rest 102 positioned in a forward configuration (said back rest 102 angled towards the rear of said chassis frame 101). In this case, the user would be seated facing towards the front end of said chassis frame 101. Any of a plurality of exercises may be achieved, which includes without limitations leg press, chess press, and rowing exercises.

Said rowing exercise is achievable by pulling against a strap that is removably connected to the base of said vertical platform 103 (possibly by hook and clip or latching means), said vertical platform 103 moving in a forward direction along said chassis frame 101.

Said chess press exercise is achieved by pushing against the handle elements 124 of said vertical platform 103 as it is moving rearward along said chassis frame. Said leg press exercise is achievable by pushing against said vertical platform 103 while it is moving rearward along said chassis frame 101, pushing being achieved by the user's legs.

Figure 5:
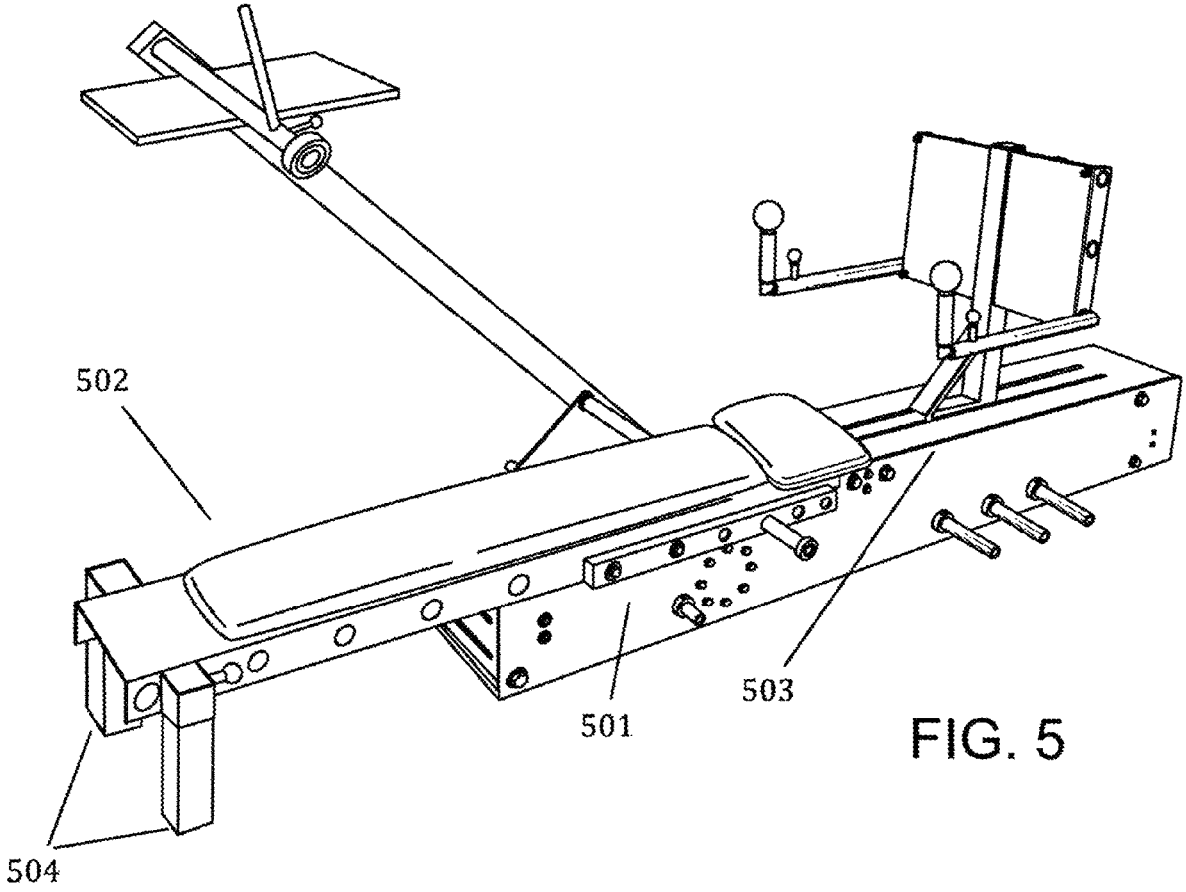
FIG. 5 provides a right side perspective view of the invention according to a preferred embodiment as illustrated.

According a preferred embodiment of the invention as illustrated in FIG. 5, the back rest element 502 may further be positioned at complete horizontal position flushly over the top surface 503 of the chassis body 501. Said back rest element may further provide a detachable leg support element 504 which helps to prop said resting element upward from the ground surface in sturdy position against the weight of the user. The detachable leg support helps to provide additional leverage. In this case, the cross-bar that was used to hold the back rest 502, at an upward angle is removed, allowing the back rest 502 to lay completely flat. Any plurality of exercises may be achieved, which includes without limitations squat, curl, and pull-down exercises.

Said squat exercise according is achievable by the user laying in full horizontal position on said back rest element and pushing his or her legs against said vertical platform as said vertical platform moves towards the user in rearward direction.

Said curl exercise is achievable by the user laying in full horizontal position on said back rest element and pulling on a strap element attached to said vertical platform while said vertical platform moves towards the front end of said chassis frame away from said user.

Said pull-down exercise is achievable by the user laying in full horizontal position on said back rest element, the user's head facing towards the front end of said chassis frame. In this case, the user pulls on the strap element, which is connected to the vertical platform as said vertical platform moves away from said user, towards the front end of said chassis frame.

FIG. 2 provides illustrations of the chassis body 101 with the back rest 102 positioned in rearward configuration (angled towards the front end of said chassis frame). In this case, the user is seated on said chassis frame 101, facing towards its rear end. Any plurality of exercises may be achieved in this position, including without limitations, dip, chess press, and abdominal exercises.

Said dip exercise is achievable by pulling a strap element in a downward direction. In this case, said strap element is connected to said vertical platform while said vertical platform moves away from the user towards the front end of said chassis frame.

Said chess press exercise is achievable in similar manner as said dip exercise, except the user would be pulling on said strap in an upwardly angled direction.

Said abdominal exercise is achievabable as well in similar manner as either said dip or chess press exercises described above, except that the straps would be leveraged over the user's shoulders, and said user would be pushing his or whole upper body downward.

Figure 6:
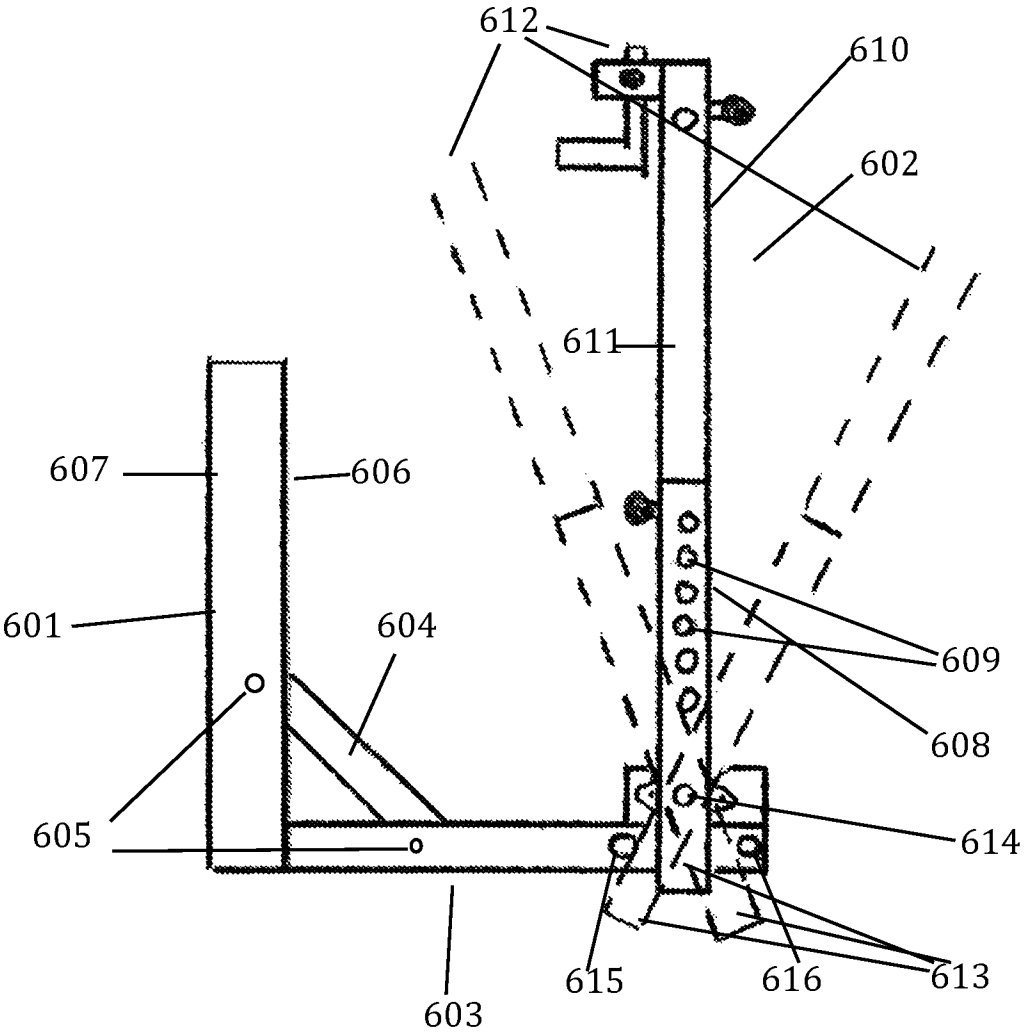
FIG. 6 provides a right-side plan view of the invention according to a preferred embodiment as illustrated.
Figure 9A:
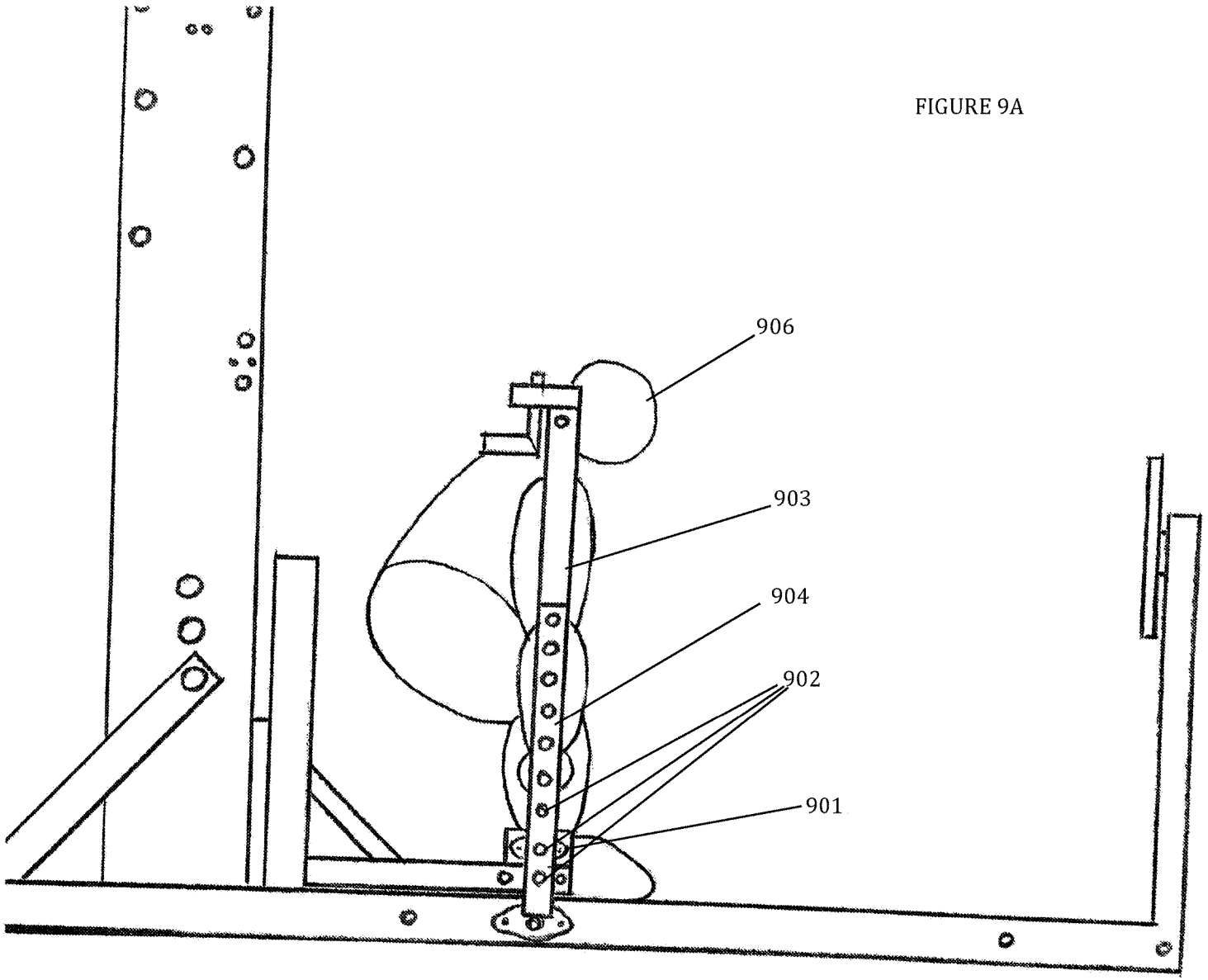
FIGS. 9*a* and 9*b* provides a right-side plan view of the invention according to a preferred embodiment as illustrated.
Figure 9B:
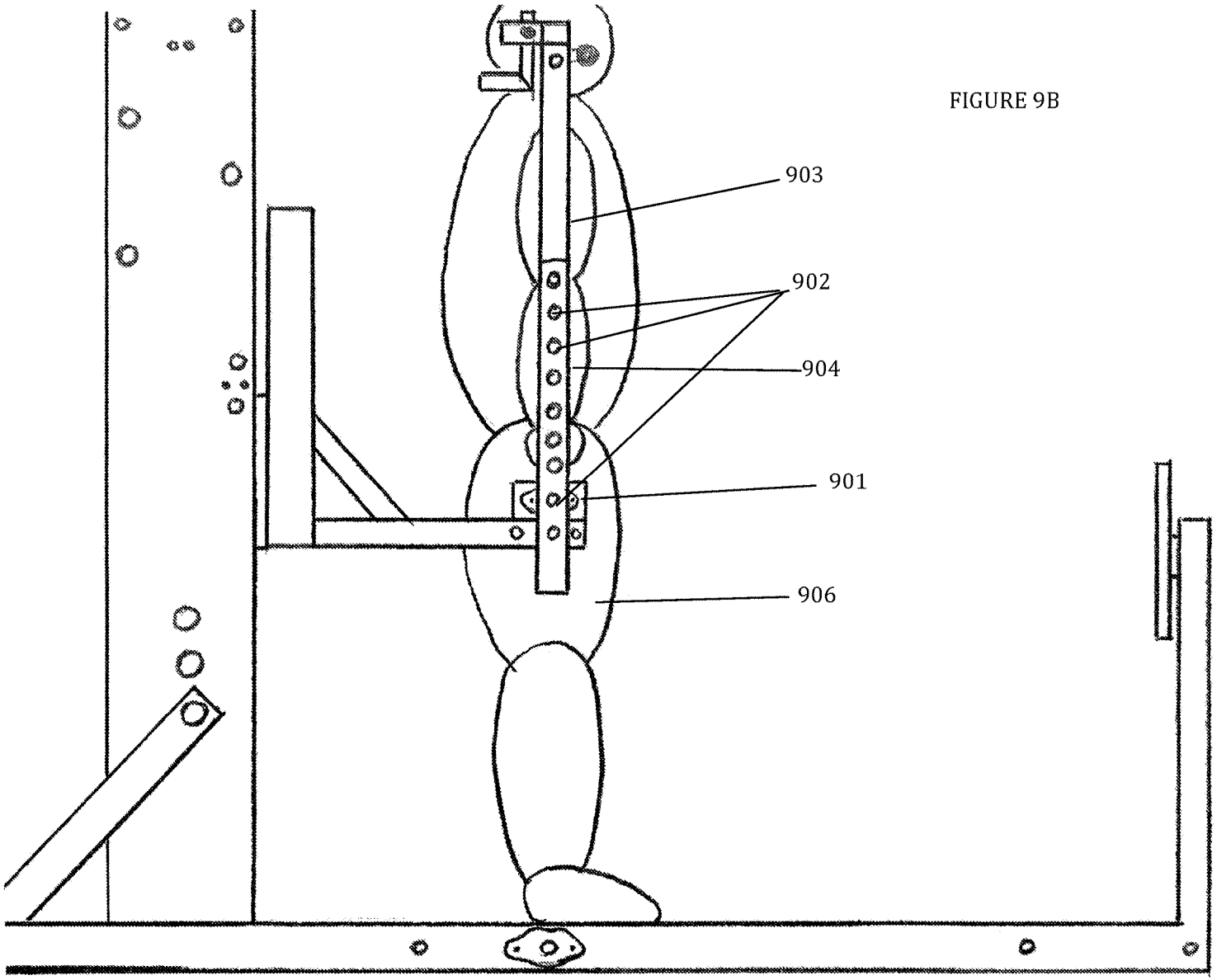
Figure 10A:
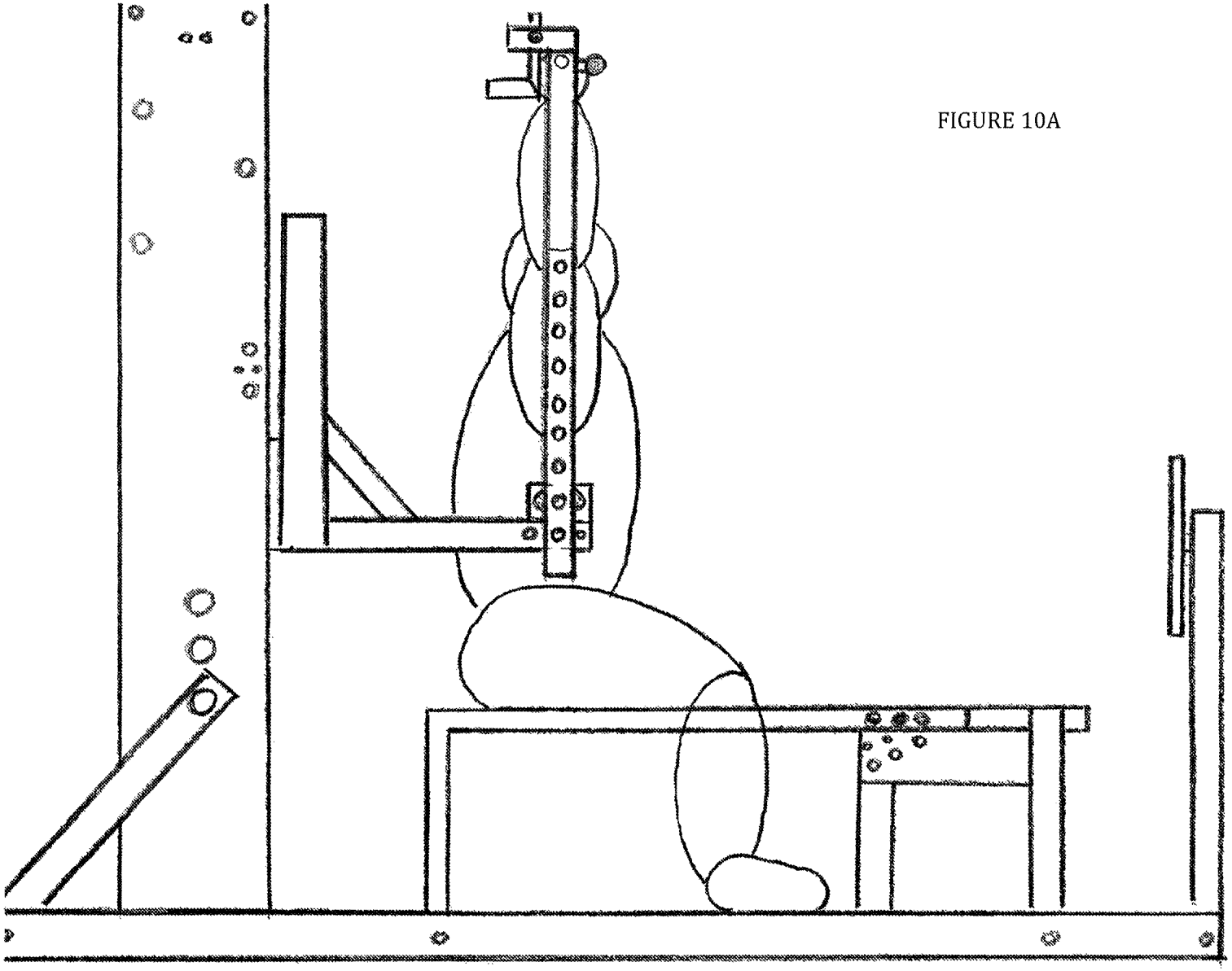
FIGS. 10*a* and 10*b* provides a right-side plan view of the invention according to a preferred embodiment as illustrated.
Figure 10B:
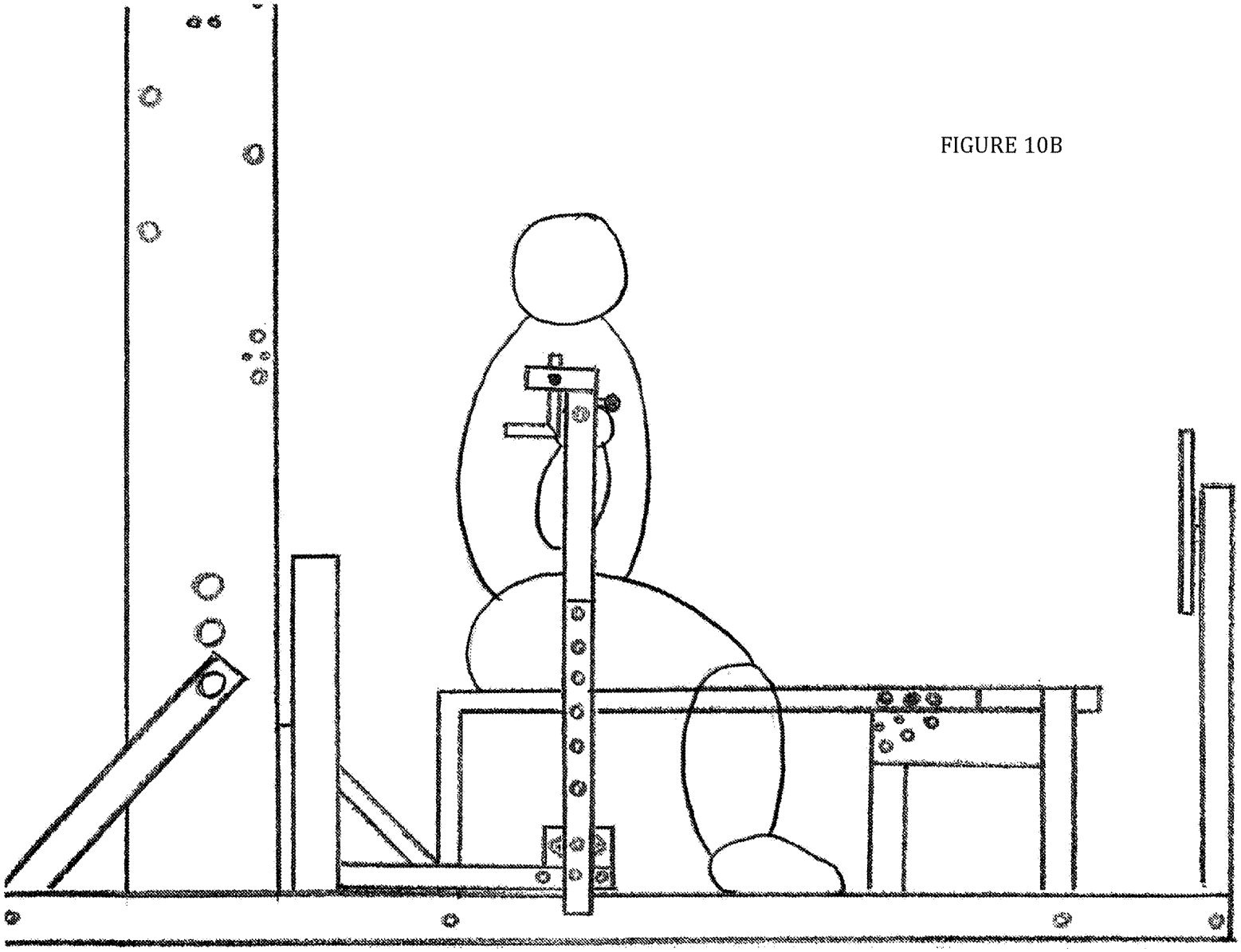
Figure 11A:
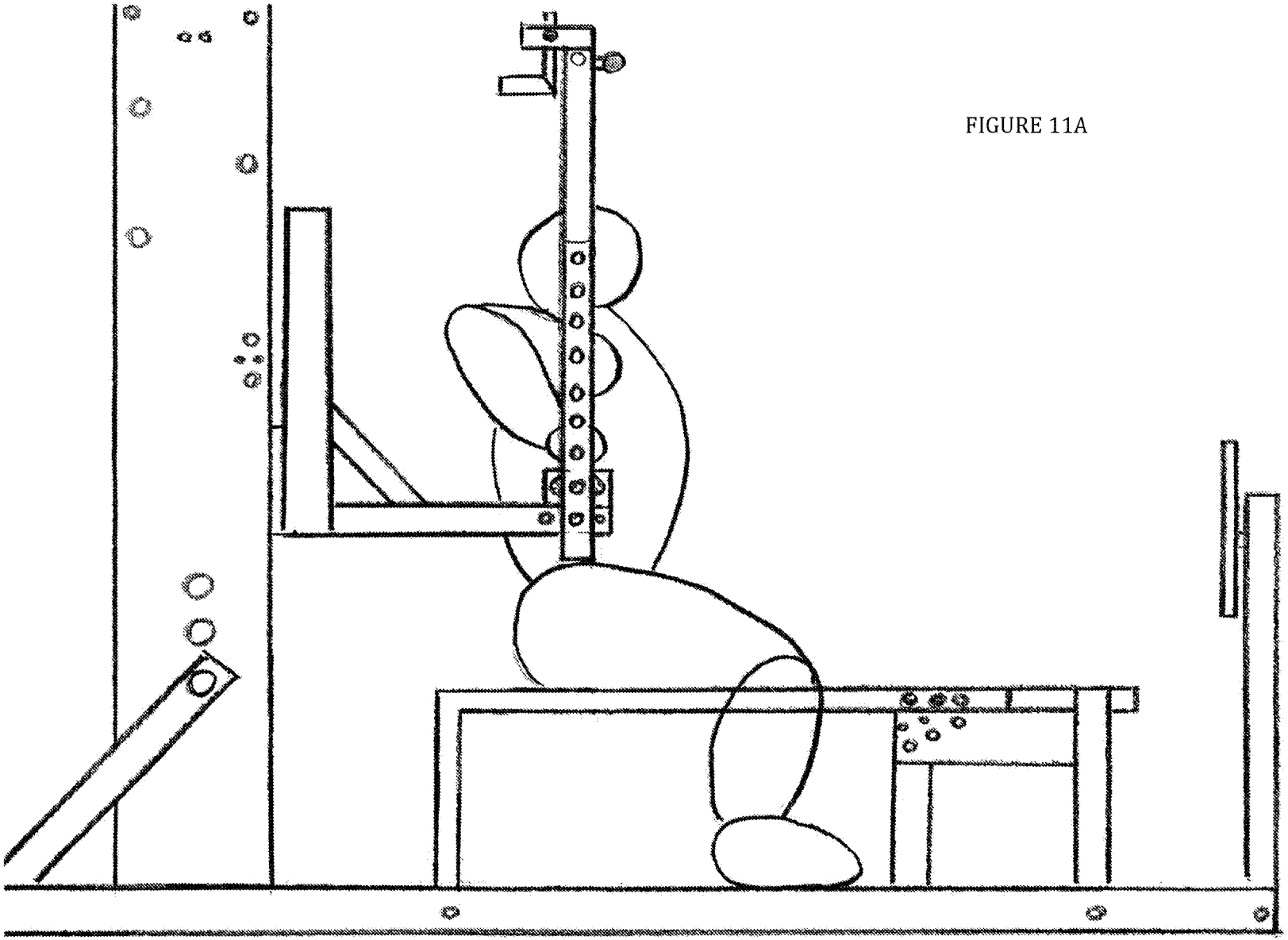
FIGS. 11*a* and 11*b* provides a right-side plan view of the invention according to a preferred embodiment as illustrated.
Figure 11B:
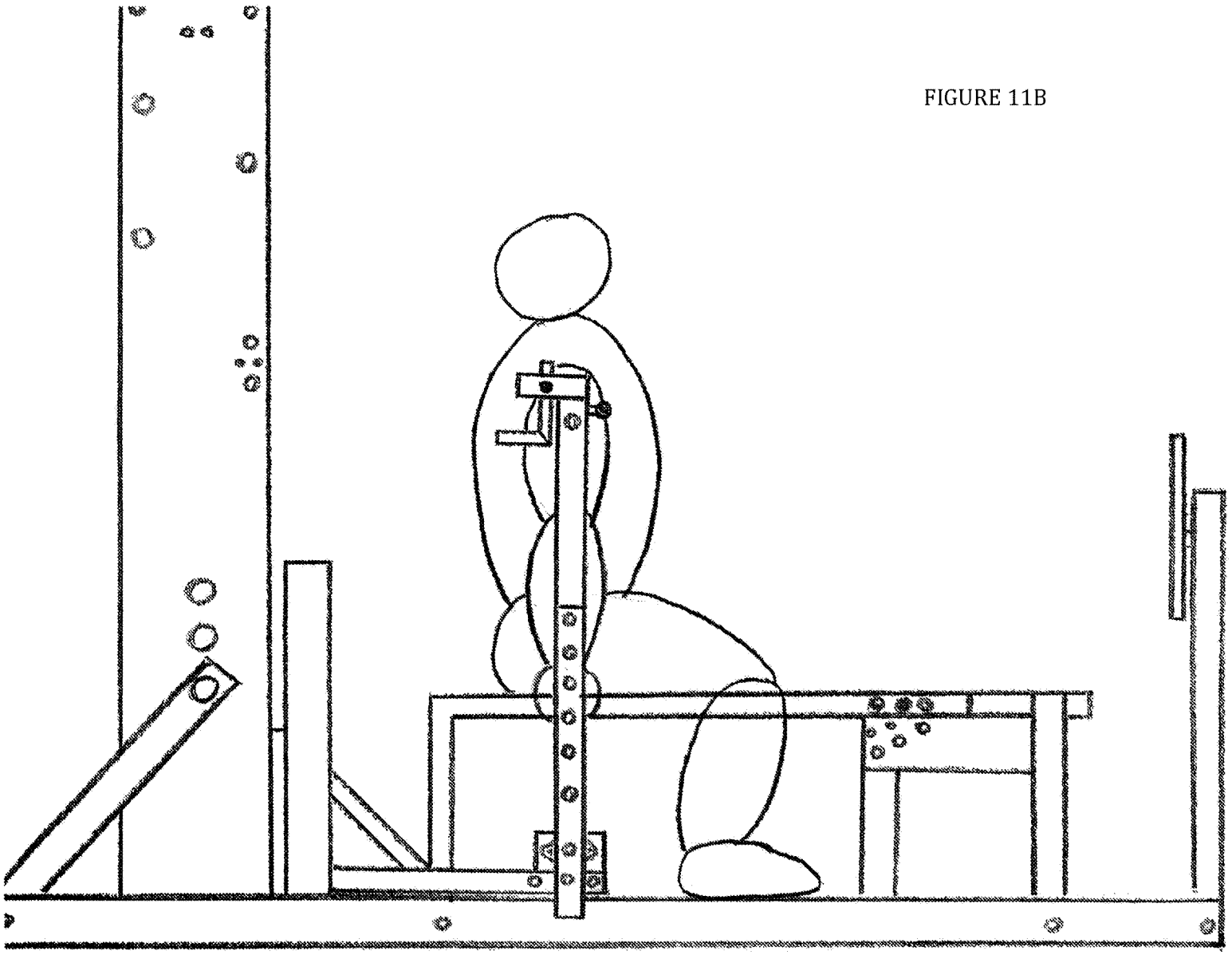
Figure 12A:
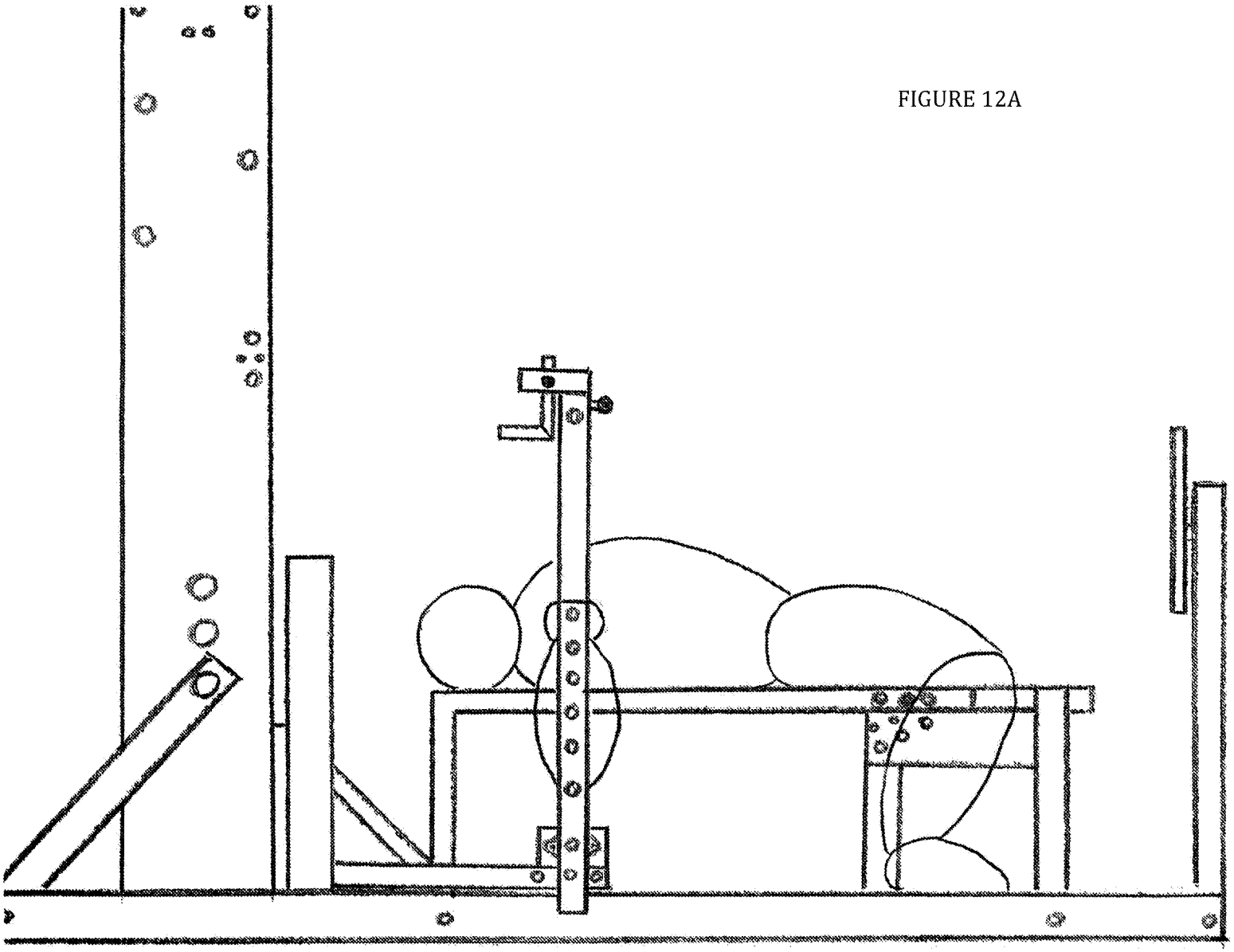
FIGS. 12*a* and 12*b* provides a right-side plan view of the invention according to a preferred embodiment as illustrated.
Figure 12B:
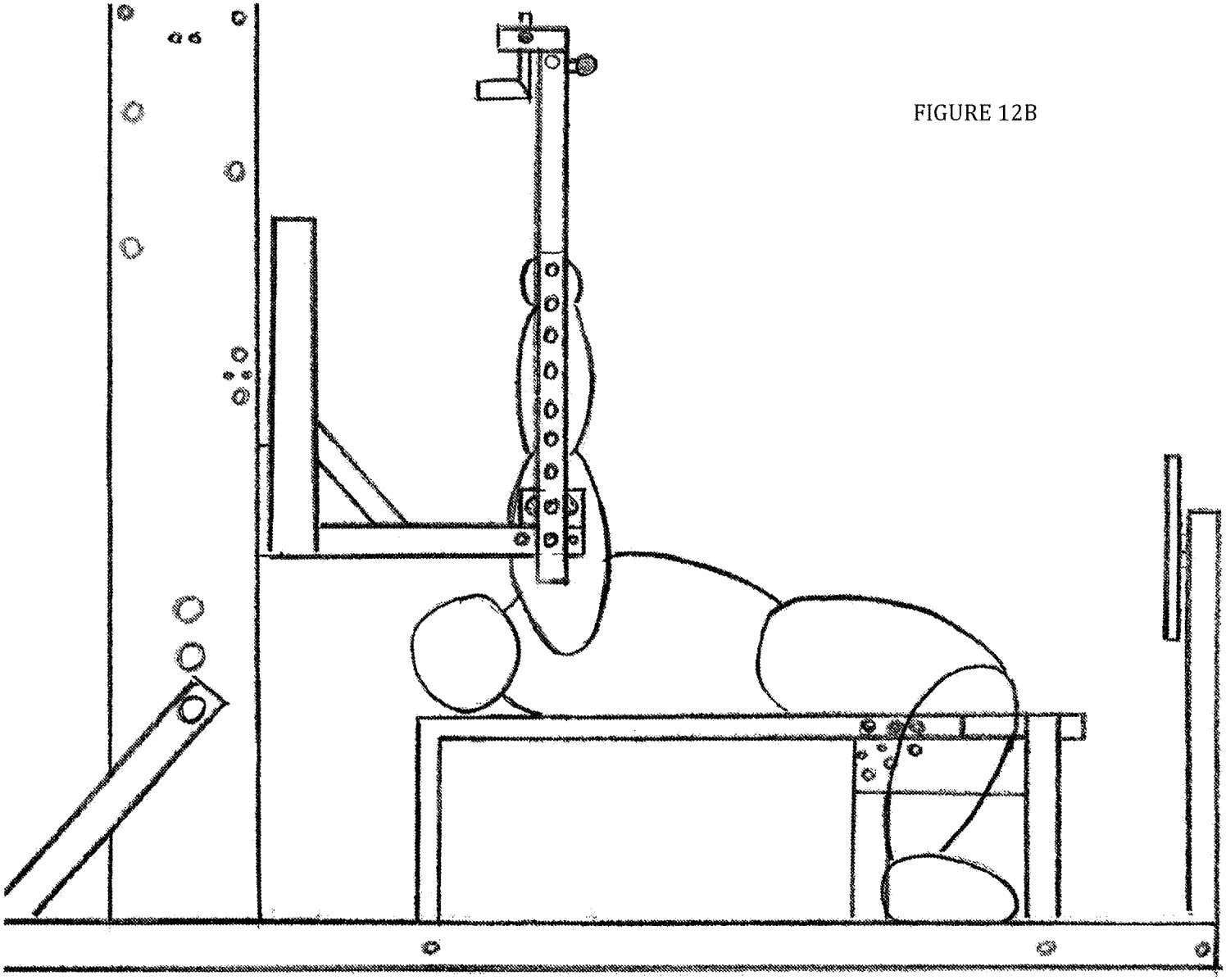

FIG. 6 provides a general illustration of a plan view of an alternative embodiment of this invention comprising a vertically positioned chassis 601 with attached exercise arm 602. Said vertically positioned chassis 601 is attached to the support frame 603 by manner of a gusset element 604. According to this illustration, the gusset element 604 comprises one gusset element 604 attached to the opposing side of this perspective of the device 600. A pin 605 is shown to have sleeved therethrough the relevant locations between the gusset 604 and support frame 603 portions and between the gusset 604 and the chassis frame 601 portions. A second gusset element (not shown in this FIG. 6 drawing) is preferably attached to the opposing side of the device for a secure connection between the vertically positioned chassis 601 and the support frame 603. The gusset feature 604 may be connected between the front side 606 of the chassis 601 to the support frame 603 as shown in FIG. 6 or between the rear side 607 of the chassis 601 to the support frame 603 as shown in FIGS. 9*a* and 9*b*.

The exercise arm 602 of this device as shown in FIG. 6 comprises a first linear arm 608 with a plurality of perforations 609 centrally positioned along its length. The device preferably having two first linear arms 608 attached thereon, one on either left and right sides of the support frame 603. Each first linear arm 608 may have a hollow space (not shown) where a second linear arm 610 bearing perforations 609 of matching dimension and spacing is sleevable into and through the first linear arm 608 for adjustable length capability. Said first 608 and second 610 linear arms may be locked into a desired position by sleeving a locking pin 611 through their matching perforations. The device of this invention provides for at least one linear arm to serve as an accessory arm wherein said linear arm may have more than one linear arm nested therein at its top end 612. The bottom end 613 of said first linear arm is further interconnected to the support frame 603 in swivel manner by a pin element 614 sleeved therethrough. A first 615 and second 616 stop shaft are located to the left and right sides of the bottom end of the first linear arm such that the first linear arm 608 is prevented from swiveling at an angle past the location of the stop shaft 615, 616. The angle of swivel for the first linear arm 610 is defined by the space between the first and second stop shafts 615, 616. The first 615 and second 616 stop shafts may be permanently welded onto the support frame 603 or alternatively may comprise a pin element sleevable through a perforation. The support frame 603 may have a plurality of perforations spaced apart from each other in radial manner (not shown in FIG. 6) such that a pin 614 may be sleeved through a preferred location on the support bar to determine the maximum swivel angle (in either forwards or rearwards position relative to linear arm in perpendicular relationship to the support frame) for the first linear arm 610.

Figure 7:
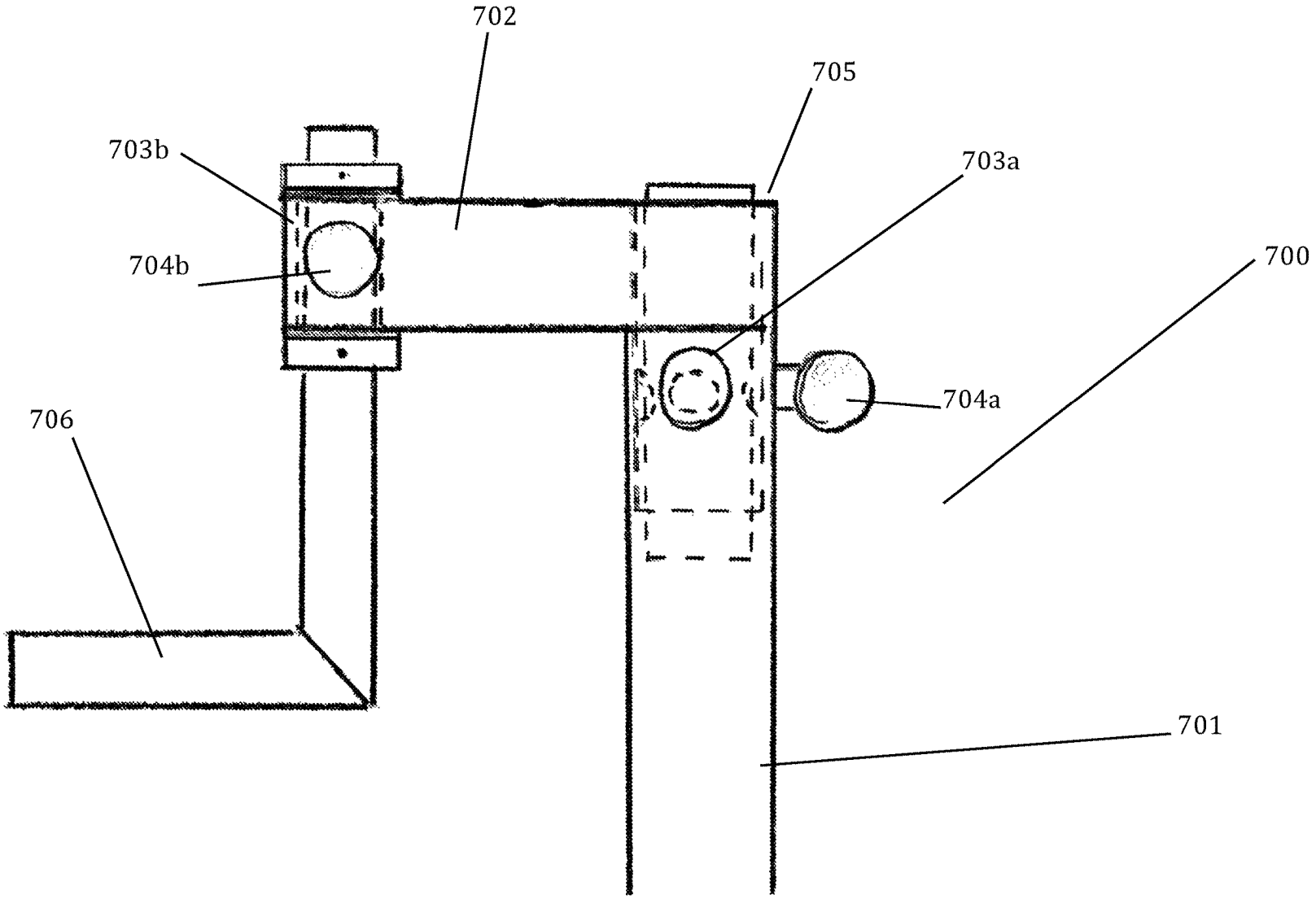
FIG. 7 provides a left-side plan view of the handle portion of the invention according to a preferred embodiment as illustrated.

FIG. 7 provides a plan view illustration of a preferred embodiment of the handle element 700 that is attachable to the top of each first linear arms 701. The handle element 700 is rotatable by a cross-bar 702 with a first 703*a* and second perforation 703*b* at its opposite ends wherein a vertical pin 704 is sleeved through both ends that sets the cross bar 702 in place along the horizontal plane. The first vertical pin 704*a* is sleeved through the first perforation 703*a* of the cross bar 702 and interconnecting with the furthest top cross-sectional end 705 of the first linear arm device 701 or the cross-sectional end 705 of the furthest nested linear arm element within the first linear arm device. The second pin 704*b* comprising a longer extended L-shaped bracket 706 which extends downward and outward from the second perforation 703*b* of the cross-bar 702. The second pin 704*b* is held in place with the second perforation 703*b* by a pop-pin locator that prevents the L-shaped bracket 706 from fall through by gravity. The interconnection between the linear arm 701 and the L-shaped handle element 706 in swivel manner may be achievable by other known means and combination of components involving pin and perforation features. The swivel feature may be obstructed by sliding a pop-pin locator 704*a* through the top end 705 of the first linear arm (or the furthest top subsequent linear bar nested within the first linear bar) and through the first vertical pin. By this obstruction, the handle is maintained in fixed position without swivel.

Figure 8A:
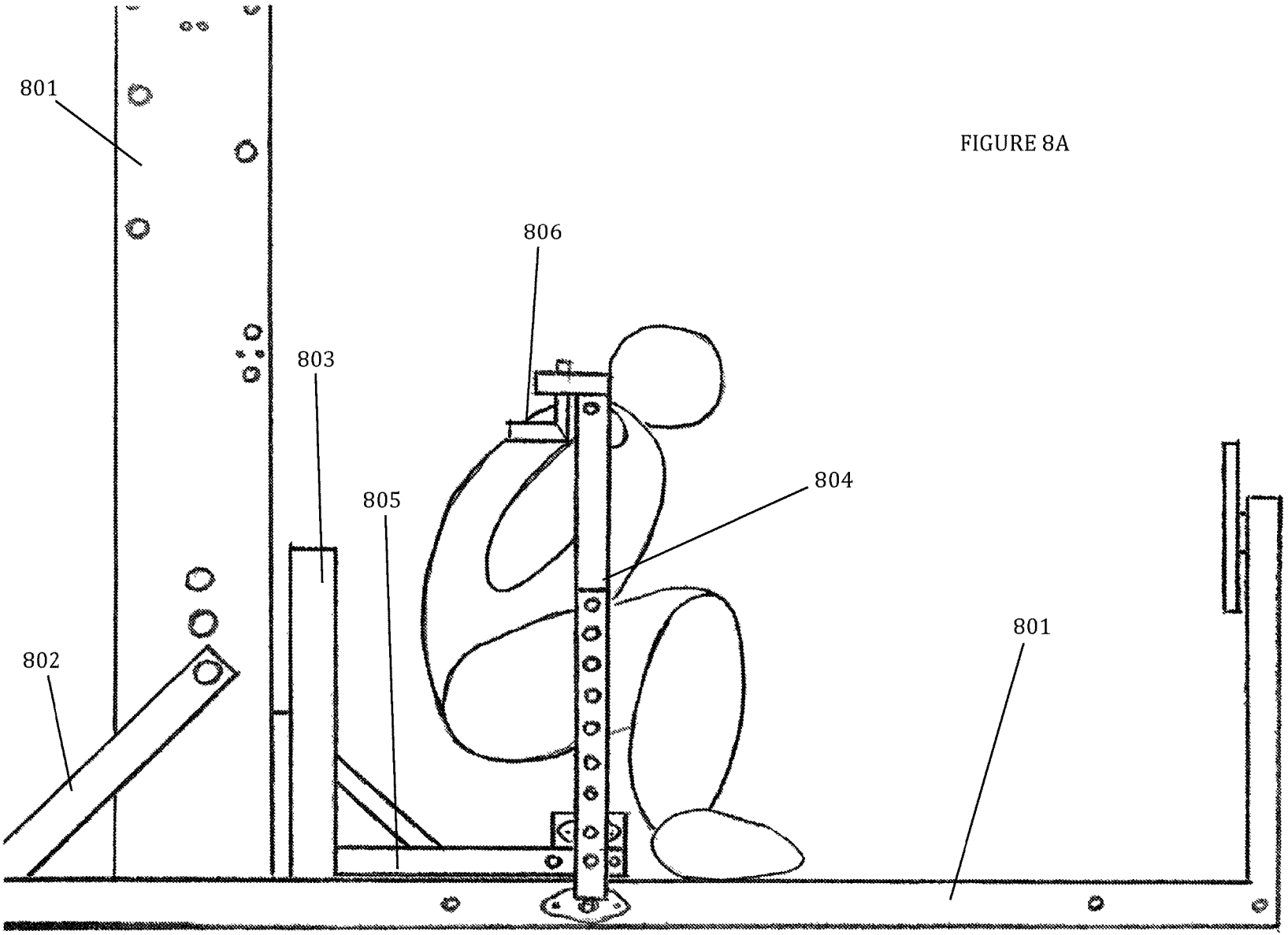
FIGS. 8*a* and 8*b* provides a right-side plan view of the invention according to a preferred embodiment as illustrated.
Figure 8B:
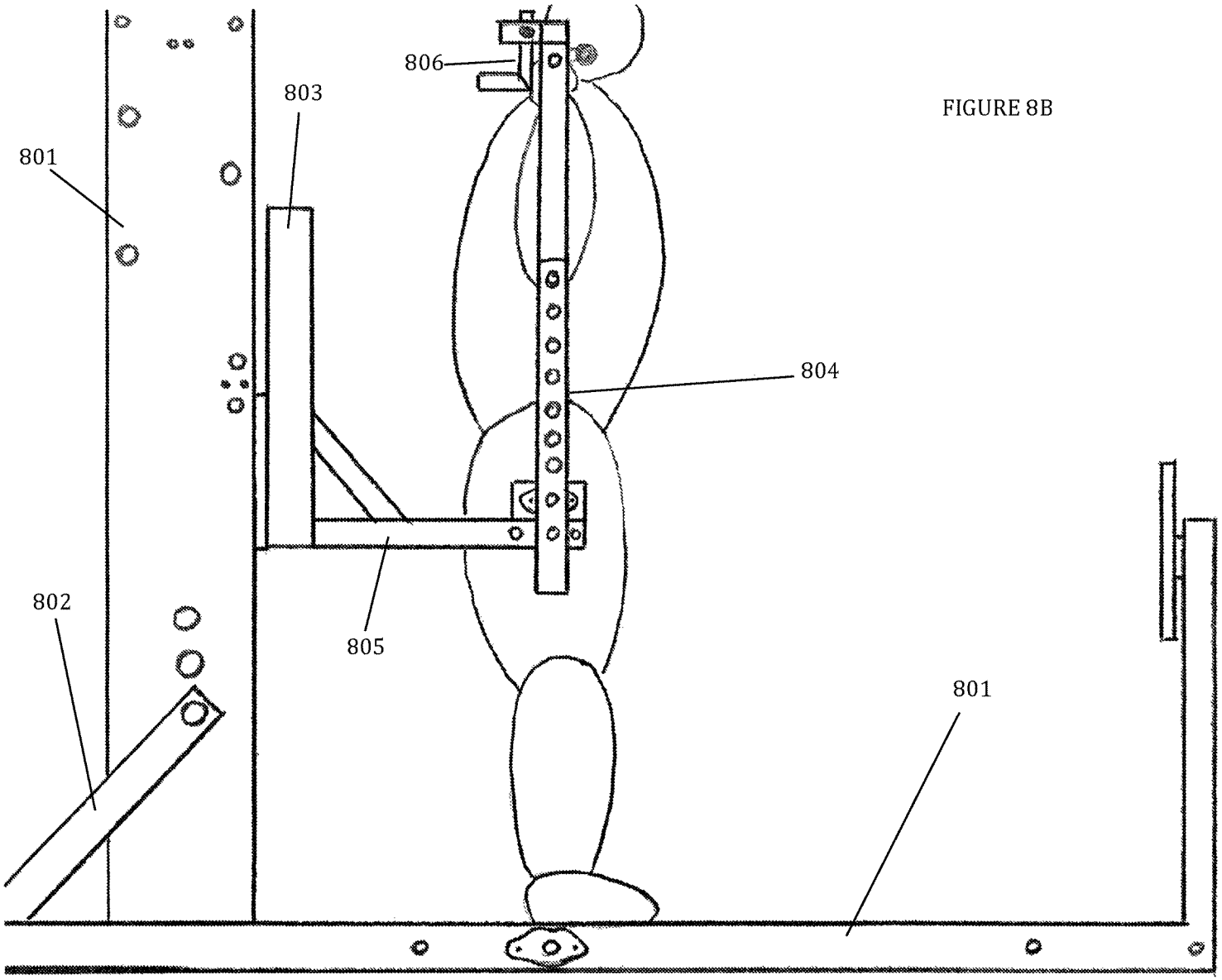
Figure 13A:
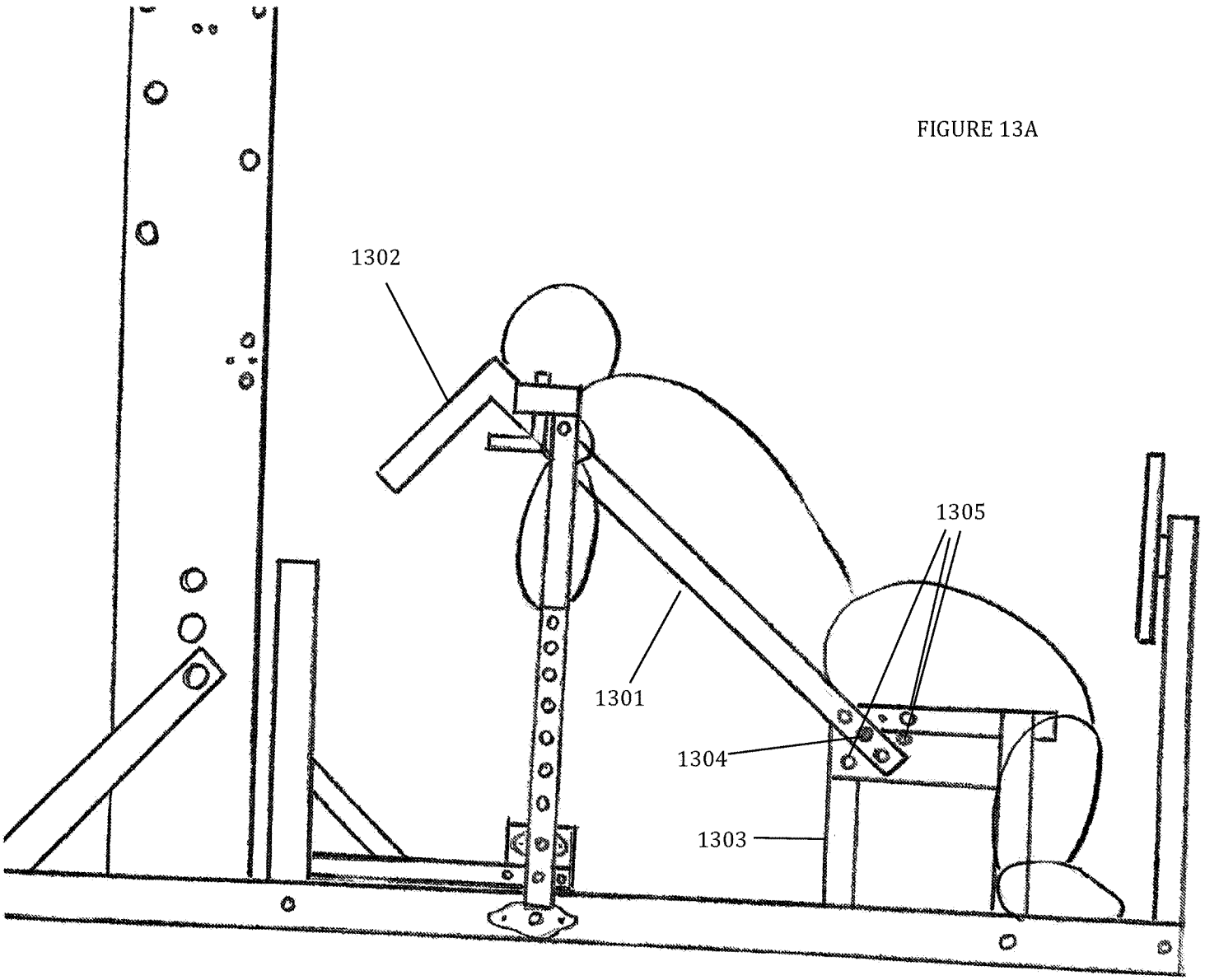
FIGS. 13*a* and 13*b* provides a right-side plan view of the invention according to a preferred embodiment as illustrated.
Figure 13B:
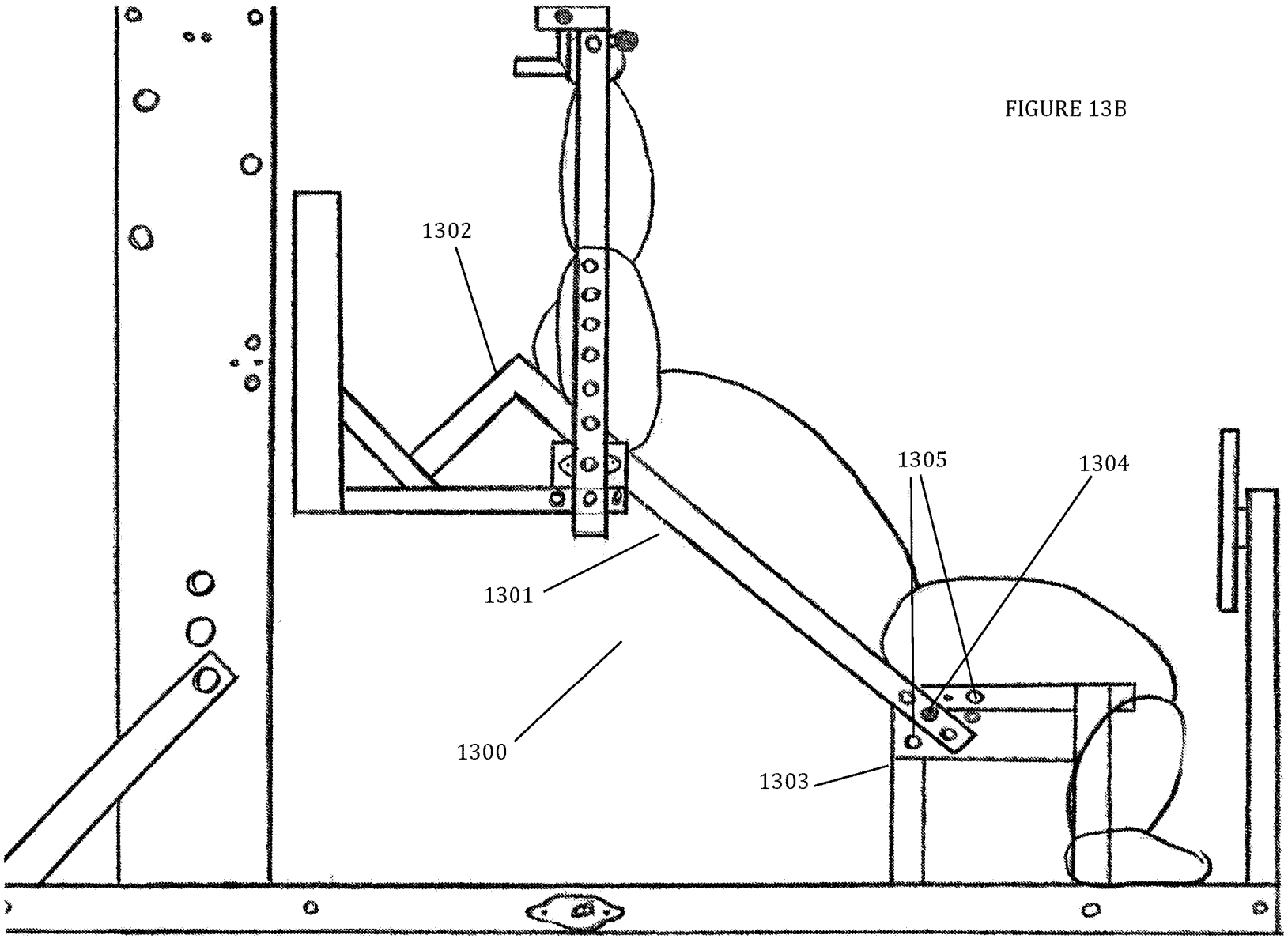

FIGS. 8*a* and 8*b* provides illustrated examples of the vertically positioned device in attachment to a horizontal support frame 801 by two gusset elements 802 at either side in rearward position from the vertically positioned chassis 801. By this embodiment, a carriage element 803 is directly connected to the vertically positioned linear screw drive held within the vertically positioned chassis frame 801. The carriage element 803 is further attached to a short platform 805 connected to a linear arm 804 with an L-shaped handle element 806 at its upper end. The carriage 803 and linear arm 804 attachment will move upward or downward by the motor driven linear screw drive action. As such, according to the embodiment of FIGS. 8*a* and 8*b*, the user may hold onto the handle elements 806 and exercise upward and downward squat motions. According to FIGS. 9*a* and 9*b*, a cross bar 901 may be sleeved through matching perforations 902 of the two linear arms 903 at the lower half end 904 of the two linear arms 903. All other features of FIGS. 9*a* and 9*b* being the same as those of FIGS. 8*a* and 8*b*. According to the configuration illustrated in FIGS. 9*a* and 9*b*, the user 906 may exercise and upward and downward deadlift exercise. FIGS. 10*a* and 10*b*, 11*a* and 11*b*, and 12*a* and 12*b* illustrates the same embodiment as presented in FIGS. 8*a* and 8*b*, but with the addition of an exercise bench 907 positioned forward of the carriage element 803. By the configuration provided in FIGS. 10*a* and 10*b*, the user may engage in the upwards and downwards movement of a pull-down and press type of exercise. By the configuration provided in FIGS. 11*a* and 11*b*, the user may engage in the upwards and downwards movement of a dip type of exercise. And by the configuration provided in FIGS. 12*a* and 12*b*, the user may engage in the upwards and downwards movement of a bench press type of exercise. The embodiment of FIGS. 13*a* and 13*b*, comprises the same as the previous embodiments of FIGS. 10*a* and 10*b*, but wherein the rearward half 1301 of the seating or bench element 1300 is raised upward at an angle for the user to be in a backward leaning position when seated thereon. The rearward half 1301 of the seating element 1300 comprising parallel L-shaped rods 1302 that swivel upwards or downwards at their pin connection 1303 to the main seating element 1304. This swivel feature may lock into place at a preferred angle of suspension by additional pin connection means 1303. The angle of suspension may be adjustable according to predetermined location of perforations along the seating element 1304. The predetermined locations of perforations 1305 according to the embodiment of FIGS. 13*a* and 13*b* comprising a radial pattern. By this modular configuration, the user may engage in an incline bench exercise.

Other features, advantages, and object of the present invention will become more apparent and be more readily understood from the following detailed description, which should be read in conjunction with the accompanying drawings.

I claim the following invention:

1. A motor-driven variable weight exercise device with a modular frame and removably attachable components comprising:

a hollow chassis frame, one or more pin elements, a carriage element, and one or more accessory elements, said hollow chassis frame having a left side, a right side, a top side, a bottom side, a first end, and a second end, said hollow chassis frame having perforations therethrough on both its right and left sides, said hollow chassis frame containing a linear actuator and motor drive located at its first end, said perforations between said right and left sides of said chassis frame being in mirror locations of each other such that one of the one or more pin elements is sleevable therethrough between said right and left side mirror perforations at a perpendicular cross-section to the length of said chassis frame, said hollow chassis frame being rotatable in a pivoting manner at its second end from horizontal to vertical positions, said carriage element directly connected to said linear actuator and extending beyond the top surface of said hollow chassis frame, said one or more accessory elements comprising one or more of the following: linear bars, handle elements, a bench, a seating element, a foot pad, cross-bars, or a support frame;

wherein each accessory element has perforations therethrough such that each said accessory element is removably attachable to said hollow chassis frame in a modular manner by interconnecting said accessory element to said hollow chassis frame by one of the one or more pin dements through matching perforations between them.

2. Said motor-driven variable weight exercise device with a modular frame and removably attachable components of claim 1, further comprising one or more gusset elements, each said one or more gusset elements having perforations therethrough, each said one or more gusset elements removably connectable to said hollow chassis frame and to one or more support frame elements.

3. Said motor-driven variable weight exercise device with a modular frame and removably attachable components of claim 1, wherein the exercise device is in remote communication with a software enabled digital device with a viewable screen interface.

4. Said motor-driven variable weight exercise device with a modular frame and removably attachable components of claim 1, wherein the exercise device is in communication with a software enabled digital device.

5. Said motor-driven variable weight exercise device with a modular frame and removably attachable components of claim 1, wherein the force exertion of said motor drive is translatable into viewable and readable data by preconfigured algorithmic software means.

6. Said motor-driven variable weight exercise device with a modular frame and removably attachable components of claim 1, wherein the exercise device is controllable by a digital panel.

7. Said motor-driven variable weight exercise device with a modular frame and removably attachable components of claim 1, wherein the cumulative weight of said hollow chassis frame, carriage, linear actuator, and motor drive is under 300 pounds in total, and wherein the length of said chassis frame is under 100 inches.

8. Said motor-driven variable weight exercise device with a modular frame and removably attachable components of claim 1, wherein the length of said hollow chassis frame is under 100 inches.

* * * * *